US011109636B2

(12) United States Patent
Arin

(10) Patent No.: US 11,109,636 B2
(45) Date of Patent: Sep. 7, 2021

(54) CUSTOMIZABLE SHOE

(71) Applicant: VIDA SHOES INTERNATIONAL INC., New York, NY (US)

(72) Inventor: Lawrence Arin, New York, NY (US)

(73) Assignee: VIDA SHOES INTERNATIONAL INC., New York, NY (US)

( * ) Notice: Subject to any disclaimer, the term of this patent is extended or adjusted under 35 U.S.C. 154(b) by 413 days.

(21) Appl. No.: 15/052,453

(22) Filed: Feb. 24, 2016

(65) Prior Publication Data

US 2017/0238645 A1 Aug. 24, 2017

(51) Int. Cl.

| | |
|---|---|
| ***A43B 3/24*** | (2006.01) |
| ***A43B 23/24*** | (2006.01) |
| ***A43B 13/04*** | (2006.01) |
| ***A43B 13/12*** | (2006.01) |
| ***A43B 3/00*** | (2006.01) |
| ***A43C 11/14*** | (2006.01) |
| ***A43B 1/00*** | (2006.01) |
| ***A43B 3/06*** | (2006.01) |
| ***A43B 23/02*** | (2006.01) |
| ***A43B 13/22*** | (2006.01) |

(52) U.S. Cl.

CPC ..... *A43B 3/24* (2013.01); *A43B 1/0081* (2013.01); *A43B 3/0078* (2013.01); *A43B 3/06* (2013.01); *A43B 3/242* (2013.01); *A43B 13/04* (2013.01); *A43B 13/12* (2013.01); *A43B 13/223* (2013.01); *A43B 23/021* (2013.01); *A43B 23/0215* (2013.01); *A43B 23/0245* (2013.01); *A43B 23/24* (2013.01); *A43C 11/1493* (2013.01)

(58) Field of Classification Search

CPC ..... A43B 3/24; A43B 1/0081; A43B 3/0078

USPC ..... 36/100

See application file for complete search history.

(56) References Cited

U.S. PATENT DOCUMENTS

| | | | | |
|---|---|---|---|---|
| 4,766,682 | A | 8/1988 | Malloy, III | |
| 5,165,190 | A | 11/1992 | Smyth | |
| 5,459,947 | A | 10/1995 | Lasher | |
| 5,566,477 | A | 10/1996 | Mathis et al. | |
| 5,857,220 | A | 1/1999 | Erny et al. | |
| 6,128,801 | A | 10/2000 | Adzick et al. | |
| 6,175,963 | B1 | 1/2001 | Loeffelholz | |
| 6,397,497 | B1 * | 6/2002 | McAtee ..... | A43B 3/0078 36/136 |
| 6,601,323 | B2 | 8/2003 | Tsujino et al. | |

(Continued)

OTHER PUBLICATIONS

Office Action issued in corresponding U.S. Appl. No. 15/964,277 dated Nov. 4, 2020 (20 pages).

*Primary Examiner* — Alissa J Tompkins
*Assistant Examiner* — Catherine M Ferreira
(74) *Attorney, Agent, or Firm* — Pillsbury Winthrop Shaw Pittman LLP

(57) ABSTRACT

A shoe system includes a sole and a shoe upper connected with the sole. A gap is disposed between a first upper portion and a second upper portion. The shoe system also includes a first permanent connector permanently connected to the first upper portion; a second permanent connector permanently connected to the second upper portion, and a removable and printable connector strap connectable with the shoe upper. First and second releasable connector portions of the removable and printable connector strap are releasably connectable with the first and second permanent connectors, respectively.

18 Claims, 23 Drawing Sheets

(56) References Cited

U.S. PATENT DOCUMENTS

| | | | | |
|---|---|---|---|---|
| 6,769,204 | B1 * | 8/2004 | Phillips | A43B 1/0081 36/100 |
| 7,003,903 | B2 | 2/2006 | Johnson | |
| 7,117,614 | B2 | 10/2006 | Tonkel | |
| 7,437,837 | B2 * | 10/2008 | Jacobs | A43B 3/24 36/50.1 |
| 7,600,334 | B2 | 10/2009 | Cox et al. | |
| 7,832,123 | B2 | 11/2010 | Fallon et al. | |
| 8,522,456 | B2 | 9/2013 | Beers et al. | |
| 8,627,516 | B2 | 1/2014 | Evans | |
| 8,863,411 | B2 * | 10/2014 | Berger | A43B 3/24 36/101 |
| 9,192,207 | B2 | 11/2015 | Koyess et al. | |
| 2002/0029494 | A1 * | 3/2002 | Small | A43B 3/0078 36/54 |
| 2004/0134100 | A1 * | 7/2004 | McVicker | A43B 1/0081 36/50.1 |
| 2005/0125972 | A1 | 6/2005 | Gibson | |
| 2010/0180469 | A1 * | 7/2010 | Baucom | A43B 3/0031 36/100 |
| 2010/0319219 | A1 * | 12/2010 | Attilieni | A43C 11/1493 36/101 |
| 2011/0302803 | A1 | 12/2011 | Kim | |
| 2012/0185996 | A1 | 7/2012 | Goldberg et al. | |
| 2013/0031803 | A1 * | 2/2013 | Koch | A43B 1/0072 36/100 |
| 2013/0031808 | A1 | 2/2013 | Holness | |
| 2013/0318827 | A1 * | 12/2013 | Ringholz | A43B 3/24 36/100 |
| 2014/0208617 | A1 | 7/2014 | Foxen et al. | |
| 2014/0223639 | A1 | 8/2014 | Betrus | |
| 2015/0033445 | A1 | 2/2015 | Warner et al. | |
| 2015/0296904 | A1 | 10/2015 | Darmetko | |

* cited by examiner 130
126
108
128
124
114
121
122
104
104a
100
100a
102
104b
L
T
S
S 130
126
108
128
124
156
114
121
122
106
104a
104
119
100b
102
104b
ANCE EMBODIMENT I
CUSTOM STRAP SIZES
SMALL - KID'S 10-13
MEDIUM - KID'S 1-3 , WOMEN'S 5-5.5
LARGE - WOMEN'S 6-9
X-LARGE - WOMEN'S 10-13
SMALL SIZE
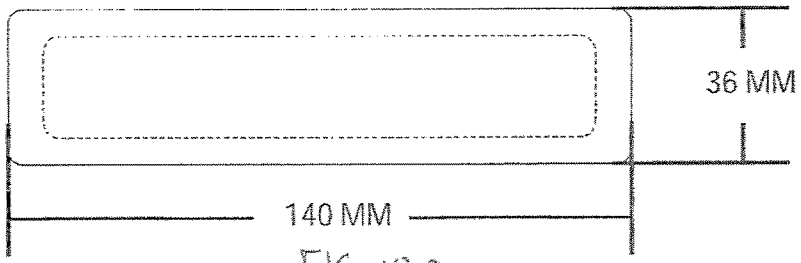
FIG. 18A
MEDIUM SIZE
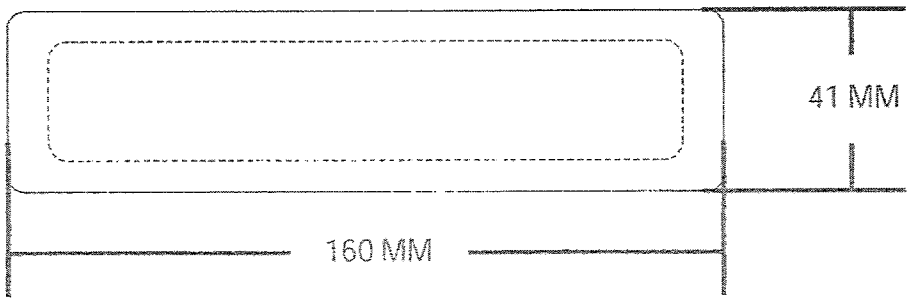
FIG. 18B
SIZING DETAILS
| WOMEN'S US SIZES | CM |
|---|---|
| 5 | 21.6 |
| 5.5 | 22.2 |
| 6 | 22.5 |
| 6.5 | 23 |
| 7 | 23.5 |
| 7.5 | 23.8 |
| 8 | 24.1 |
| 8.5 | 24.6 |
| 9 | 25.1 |
| 10 | 25.9 |
| 11 | 26.7 |
| 12 | 27.6 |
| 13 | 27.9 |
| KID'S US SIZES | CM |
|---|---|
| 10 | 16.1 |
| 11 | 17.1 |
| 12 | 18.1 |
| 13 | 19.1 |
| 1 | 19.7 |
| 2 | 20.6 |
| 3 | 21.6 |
FIG. 21

EMBODIMENT I

CUSTOM STRAP SIZES

SMALL - KID'S 10-13

MEDIUM - KID'S 1-3, WOMEN'S 5-5.5

LARGE - WOMEN'S 6-9

X-LARGE - WOMEN'S 10-13

SIZING DETAILS

| WOMEN'S US SIZES | CM |
|---|---|
| 5 | 21.6 |
| 5.5 | 22.2 |
| 6 | 22.5 |
| 6.5 | 23 |
| 7 | 23.5 |
| 7.5 | 23.8 |
| 8 | 24.1 |
| 8.5 | 24.6 |
| 9 | 25.1 |
| 10 | 25.9 |
| 11 | 26.7 |
| 12 | 27.6 |
| 13 | 27.9 |

| KID'S US SIZES | CM |
|---|---|
| 10 | 16.1 |
| 11 | 17.1 |
| 12 | 18.1 |
| 13 | 19.1 |
| 1 | 19.7 |
| 2 | 20.6 |
| 3 | 21.6 |

CUSTOM STRAP WOMEN 6 SIZE SAMPLE

LARGE SIZE

X-LARGE SIZE

EMBODIMENT II

CUSTOM STRAP SIZES

SMALL - KID'S 10-13

MEDIUM - KID'S 1-3 , WOMEN'S 5-5.5

LARGE - WOMEN'S 6-9

X-LARGE - WOMEN'S 10-13

SMALL SIZE

MEDIUM SIZE

SIZING DETAILS

| WOMEN'S US SIZES | CM |
|---|---|
| 5 | 21.6 |
| 5.5 | 22.2 |
| 6 | 22.5 |
| 6.5 | 23 |
| 7 | 23.5 |
| 7.5 | 23.8 |
| 8 | 24.1 |
| 8.5 | 24.6 |
| 9 | 25.1 |
| 10 | 25.9 |
| 11 | 26.7 |
| 12 | 27.6 |
| 13 | 27.9 |

| KID'S US SIZES | CM |
|---|---|
| 10 | 16.1 |
| 11 | 17.1 |
| 12 | 18.1 |
| 13 | 19.1 |
| 1 | 19.7 |
| 2 | 20.6 |
| 3 | 21.6 |

EMBODIMENT II

CUSTOM STRAP SIZES

SMALL - KID'S 10-13

MEDIUM - KID'S 1-3, WOMEN'S 5-5.5

LARGE - WOMEN'S 6-9

X-LARGE - WOMEN'S 10-13

SIZING DETAILS

| WOMEN'S US SIZES | CM |
|---|---|
| 5 | 21.6 |
| 5.5 | 22.2 |
| 6 | 22.5 |
| 6.5 | 23 |
| 7 | 23.5 |
| 7.5 | 23.8 |
| 8 | 24.1 |
| 8.5 | 24.6 |
| 9 | 25.1 |
| 10 | 25.9 |
| 11 | 26.7 |
| 12 | 27.6 |
| 13 | 27.9 |

| KID'S US SIZES | CM |
|---|---|
| 10 | 16.1 |
| 11 | 17.1 |
| 12 | 18.1 |
| 13 | 19.1 |
| 1 | 19.7 |
| 2 | 20.6 |
| 3 | 21.6 |

CUSTOM STRAP WOMEN 6 SIZE SAMPLE

LARGE SIZE

X-LARGE SIZE

EMBODIMENT III

FOLDOVER CUSTOM STRAP SIZE

SMALL - KID'S 10-13
MEDIUM - KID'S 1-3 , WOMEN'S 5-5.5
LARGE - WOMEN'S 6-9
X-LARGE - WOMEN'S 10-13

SIZING DETAILS

| WOMEN'S US SIZES | CM |
|---|---|
| 5 | 21.6 |
| 5.5 | 22.2 |
| 6 | 22.5 |
| 6.5 | 23 |
| 7 | 23.5 |
| 7.5 | 23.8 |
| 8 | 24.1 |
| 8.5 | 24.6 |
| 9 | 25.1 |
| 10 | 25.9 |
| 11 | 26.7 |
| 12 | 27.6 |
| 13 | 27.9 |

| KID'S US SIZES | CM |
|---|---|
| 10 | 16.1 |
| 11 | 17.1 |
| 12 | 18.1 |
| 13 | 19.1 |
| 1 | 19.7 |
| 2 | 20.6 |
| 3 | 21.6 |

SMALL SIZE

MEDIUM SIZE

EMBODIMENT III

FOLDOVER CUSTOM STRAP SIZE

SMALL - KID'S 10-13

MEDIUM - KID'S 1-3, WOMEN'S 5-5.5

LARGE - WOMEN'S 6-9

X-LARGE - WOMEN'S 10-13

SIZING DETAILS

| WOMEN'S US SIZES | CM |
|---|---|
| 5 | 21.6 |
| 5.5 | 22.2 |
| 6 | 22.5 |
| 6.5 | 23 |
| 7 | 23.5 |
| 7.5 | 23.8 |
| 8 | 24.1 |
| 8.5 | 24.6 |
| 9 | 25.1 |
| 10 | 25.9 |
| 11 | 26.7 |
| 12 | 27.6 |
| 13 | 27.9 |

| KID'S US SIZES | CM |
|---|---|
| 10 | 16.1 |
| 11 | 17.1 |
| 12 | 18.1 |
| 13 | 19.1 |
| 1 | 19.7 |
| 2 | 20.6 |
| 3 | 21.6 |

FOLDOVER CUSTOM WOMEN 6 SIZE SAMPLE

CUSTOMIZABLE SHOE

FIELD

The present patent application relates to shoe footwear.

BACKGROUND

A shoe system generally includes a sole for supporting a foot of a wearer, and an upper that is secured to the sole. Customized shoes can be very expensive or difficult to manufacture. There is a need for a customizable shoe system that is cost-effective, and that does not lose functionality, fit and/or comfort.

The present patent application provides improvements to the shoe systems.

SUMMARY

One aspect of the present patent application provides a shoe system. The shoe system includes a sole and a shoe upper connected with the sole. The shoe upper includes a first upper portion and a second upper portion, wherein a gap is disposed between the first upper portion and the second upper portion. The shoe system also includes a tongue below the shoe upper and at least partially spanning the gap between the first upper portion and the second upper portion. The shoe system also includes a first permanent connector positioned on the first upper portion, the first permanent connector being permanently connected to the first upper portion; a second permanent connector positioned on the second upper portion, the second permanent connector being permanently connected to the second upper portion, and a removable and printable connector strap connectable with the shoe upper. The removable and printable connector strap comprises a first releasable connector portion and a second releasable connector portion. The first releasable connector portion is releasably connectable with the first permanent connector, and the second releasable connector portion is releasably connectable with the second permanent connector. At least one of the first releasable connector portion and the second releasable connector portion of the removable and printable connector strap is configured to be selectively adjustably connectable with the corresponding first permanent connector and/or second permanent connector of the shoe upper so as to span the gap between the first upper portion and the second upper portion and allow adjustment of the shoe upper around a wearer's foot.

Another embodiment provides a method of assembling a shoe system. The method includes receiving a shoe system that has been shipped. The shoe system includes a sole and a shoe upper connected with the sole. The shoe upper includes a first upper portion and a second upper portion. The shoe system also includes a first permanent connector positioned on the first upper portion, the first permanent connector being permanently connected to the first upper portion; a second permanent connector positioned on the second upper portion, the second permanent connector being permanently connected to the second upper portion; and a removable and printable connector strap connectable with the shoe upper. The removable and printable connector strap comprises a first releasable connector portion and a second releasable connector portion, the first releasable connector portion being releasably connectable with the first permanent connector, and the second releasable connector portion being releasably connectable with the second permanent connector. The method also includes positioning the removable and printable connector strap in a printer, while the removable and printable connector strap is entirely removed and separated from the shoe upper and printing indicia onto the removable and printable connection strap with the printer.

These and other aspects of the present patent application, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the present patent application, the structural components illustrated herein are drawn to scale. It is to be expressly understood, however, that the drawings are for the purpose of illustration and description only and are not intended as a definition of the limits of the present patent application. It shall also be appreciated that the features of one embodiment disclosed herein can be used in other embodiments disclosed herein. As used in the specification and in the claims, the singular form of "a", "an", and "the" include plural referents unless the context clearly dictates otherwise. As used herein, the term "may" as used in connection with any structural or functional attributes, will in some embodiments have those attributes, but that such structural or functional attributes are not required in all embodiments.

BRIEF DESCRIPTION OF THE DRAWINGS

Various embodiments will now be disclosed, by way of example only, with reference to the accompanying schematic drawings in which corresponding reference symbols indicate corresponding parts, in which

FIGS. 2A-5C show the shoe systems of FIGS. 1A-1B, wherein FIGS. 2A and 3A show a left and a right side elevational views, respectively of a right shoe system, FIGS. 4A and 5A show a left and a right side elevational views, respectively of a left shoe system, FIGS. 4B and 5B show front perspective views of the left shoe system, FIGS. 4C and 5C show bottom plan views, respectively of the removable and printable connector strap;

FIGS. 18A-18D show removable and printable connector straps for different sized shoe systems in accordance with an embodiment of the present patent application;

FIG. 21 shows a table with the shoe system sizing details in accordance with an embodiment of the present patent application.

DETAILED DESCRIPTION OF THE DRAWINGS

Figures 1A, 1B:
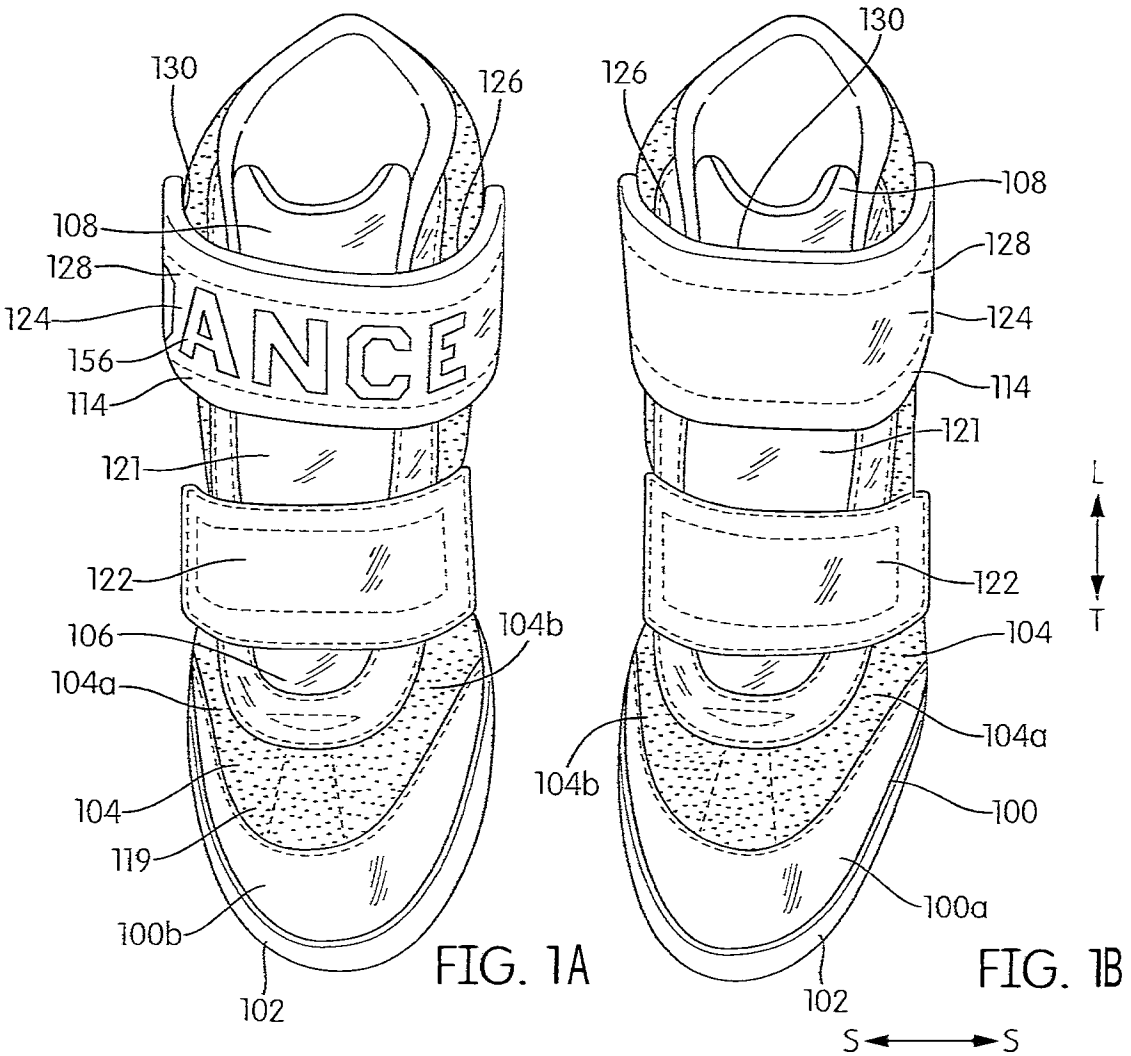
FIGS. 1A-1B show front perspective views of shoe systems in accordance with an embodiment of the present patent application.

Referring to FIGS. 1A-1B, in one embodiment, the present patent application discloses a shoe system 100. For example, FIGS. 1A-1B show a left shoe system 100 *a* generally worn on a left foot of a wearer and a right shoe system 100 *b* generally worn on a right foot of the wearer. In one embodiment, the left shoe system 100 *a* is a mirror image of the right shoe system 100 *b* and the left and right shoe systems 100 *a* and 100 *b* together form a pair of shoe systems.

In one embodiment, the term "shoe system" may refer to any type of shoe or footwear, including, but not limited to, boots, athletic or sports shoes (e.g., tennis, walking/running, rock/mountain climbing, cleats, etc.), dance shoes, golf shoes, ice or roller skate shoes, hiking boots, bowling shoes, ski boots, high-ankle fashion shoes, and other similar footwear or shoe. In one embodiment, the "shoe system" may refer to any shoe or footwear that is designed to fit one or more of an adult (male or female) or a child. In one embodiment, the "shoe system" may have any size, color (or combination thereof), material and width. In the embodiments illustrated herein, the shoe's illustrated are sneakers.

In one embodiment, the shoe system 100 may include a high-top shoe system, for example, as shown in FIGS. 6-12B. In one embodiment, the shoe system 100 may instead be a low-top shoe system. In one embodiment, the shoe system 100 may be easily convertible between a high-top shoe system configuration and a low-top (a mid-top) shoe system configuration, for example, as shown in FIGS. 13A-16, which can be accommodated by a zipper system.

Figure 2B:
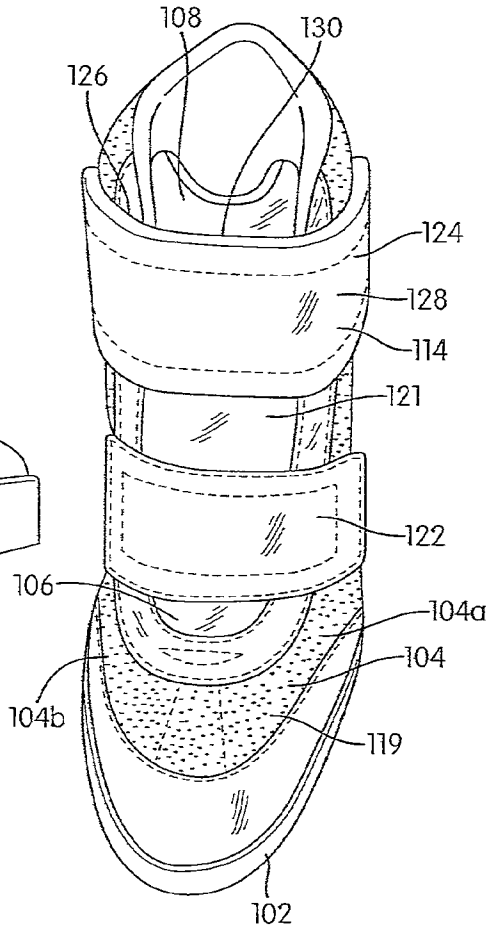
FIGS. 2B and 3B show front perspective views of the right shoe system.
Figure 2A:
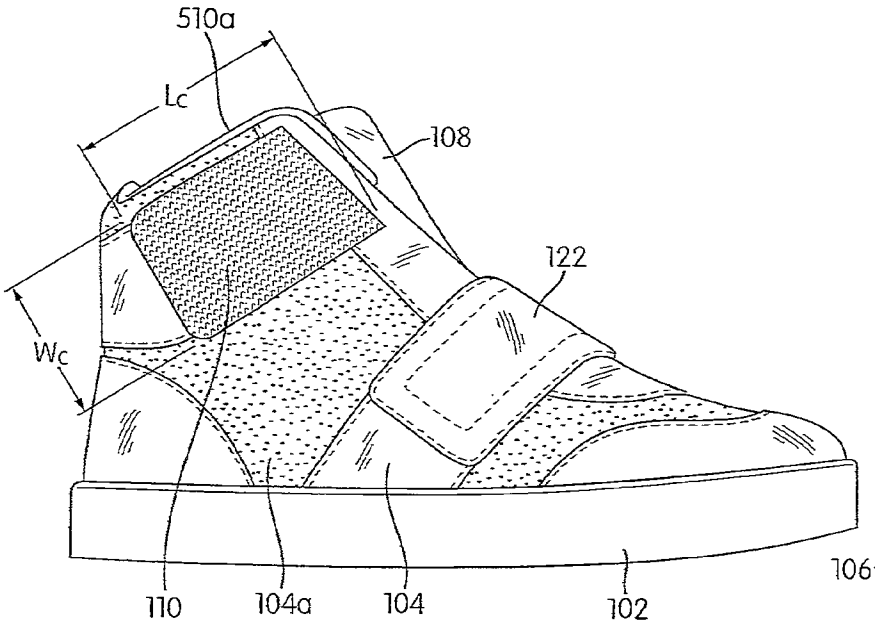

FIGS. 2A-5C show the shoe systems of FIGS. 1A and 1B. For example, FIGS. 2A and 3A show a left and right side devotional views, respectively of the right shoe system 100 *a*, while FIGS. 4A and 5A show a left and a right side elevational views, respectively of the left shoe system 100 *b*.

In one embodiment, referring to FIGS. 1-5, the shoe system 100 includes a sole 102 and a shoe upper 104 connected with the sole 102. In one embodiment, the shoe upper 104 includes a first upper portion 104*a* and a second upper portion 104*b*. In one embodiment, a gap 106 is disposed between the first upper portion 104*a* and the second upper portion 104*b*. In one embodiment, the shoe system 100 includes a tongue 108 that is below the shoe upper 104 and at least partially spanning the gap 106 between the first upper portion 104*a* and the second upper portion 104*b*. In one embodiment, a first permanent connector 110 is positioned on the first upper portion 104*a*. In one embodiment, the first permanent connector 110 is permanently connected to the first upper portion 104*a*. In one embodiment, a second permanent connector 112 is positioned on the second upper portion 104*b*. In one embodiment, the second permanent connector 112 is permanently connected to the second upper portion 104*b*. In one embodiment, the shoe upper 104 has a first side 104L and a second side 104R opposite to the first side 104L. As shown in FIGS. 4*c* and 5*c*, the first side 104L is located on one side of the gap 106 of the shoe upper 104 and the second side 104R is on an opposite side of the gap 106 of the shoe upper 104. The removable and printable connector strap 114 can be connected across the first side 104L and the second side 104R of the shoe upper 104 to achieve tightness adjustment of the shoe upper 104 around a foot of a wearer.

Figure 2C:
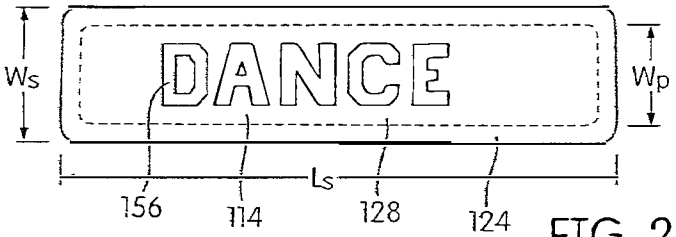
FIGS. 2C and 3C show top plan views, respectively of the removable and printable connector strap
Figure 3B:
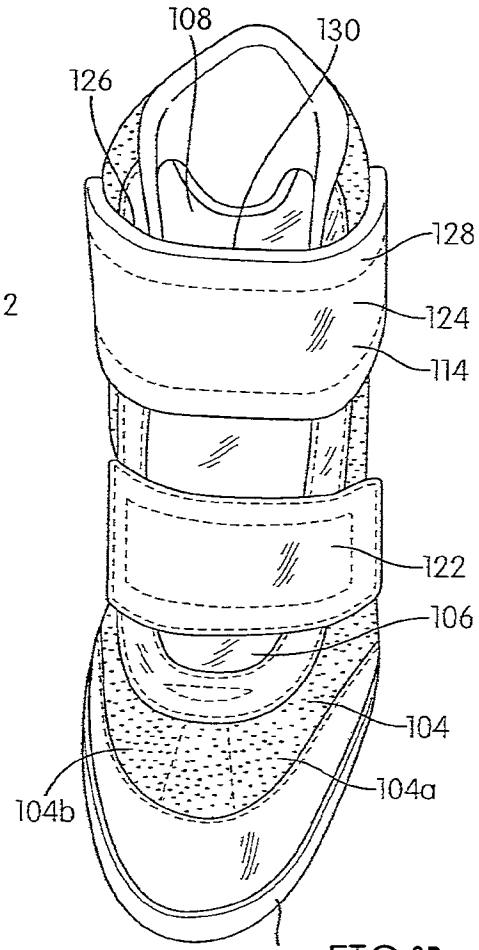
Figure 3A:
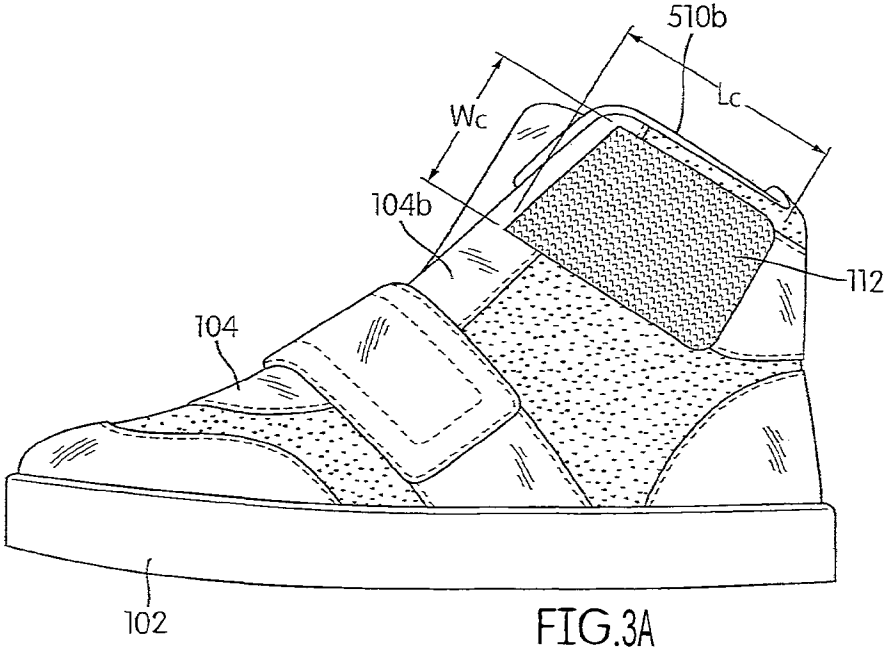
Figure 3C:
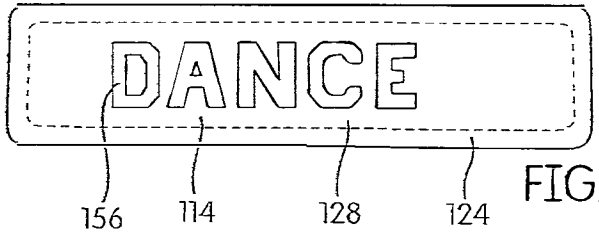

In one embodiment, a removable and printable connector strap 114 is connectable with the shoe upper 104. For example, the removable and printable connector strap 114 of the right shoe system 100 *b* is removed from and positioned adjacent to the right shoe system 100 *b* in FIGS. 2A and 3A and top plan views of the removable and printable connector strap 114 are also shown in FIGS. 2C and 3C. Similarly, the removable and printable connector strap 114 of the left shoe system 100 *a* is removed from and positioned adjacent to the left shoe system 100 *a* in FIGS. 4A and 5A, and bottom plan views of the removable and printable connector strap 114 are shown in FIGS. 4C and 5C.

In one embodiment, in FIGS. 1-5, the removable and printable blank connector strap 114 of the right shoe system 100*b* has indicia 156 (as will be explained in detail in the discussions below) printed thereon, while the removable and printable blank connector strap 114 of the left shoe system 100*a* does not have the indicia 156 printed thereon.

In one embodiment, as shown in FIGS. 4A-5C, the removable and printable connector strap 114 includes a first releasable connector portion 116 and a second releasable connector portion 118. In one embodiment, the first releasable connector portion 116 is releasably connectable with the first permanent connector 110, and the second releasable connector portion 118 is releasably connectable with the second permanent connector 112. The structural configuration of the first releasable connector portion 116 and the second releasable connector portion 118 of the removable and printable connector strap 114, and the first permanent connector 110 and the second permanent connector 112 of the shoe upper 104 are explained in detail in the discussion below.

In one embodiment, the sole 102 is the bottom of the shoe system 100. In one embodiment, the sole 102 may be made of natural rubber material, polyurethane (PU) material, poly vinyl chloride (PVC) material, elastomer material or any other synthetic material as would be appreciated by one skilled in the art. In one embodiment, the sole 102 may be made of a variety of rubber or plastic compound materials. For example, in one embodiment, the sole 102 may be made from crepe natural rubber material or latex rubber material. In one embodiment, the sole 102 may be made of thermoplastic elastomer (TPE) material or thermoplastic rubber (TPR) material. In one embodiment, to provide a light weight construction to the shoe system 100, the sole 102 may be made of ethylene vinyl acetate (EVA) material. En one embodiment, the ethylene vinyl acetate (EVA) material may be covered with small portions of rubber material or thermoplastic rubber (TPR) material, for example, on the high abrasion areas. In one embodiment, the outsole of shoe system 100 may be made from a flocking procedure, in which a leather compound is sprayed into the rubber material of the sole to cover at least 50% or more of the surface area of the sole. In one embodiment, instead of the leather material, the flocking procedure uses textile that is laid into the rubber material (instead of being sprayed).

In one embodiment, the sole 102 may include a single layer. In one embodiment, the sole 102 may be made of a single material. In another embodiment, the sole 102 may include multiple layers, each layer may be made of same material or different materials.

In one embodiment, the sole 102 may include an insole, an outsole and a midsole that is positioned between the insole and the outsole. In one embodiment, the insole is an interior bottom of the shoe system 100 with which the wearer's foot is in contact when the shoe system 100 is being worn by the wearer. In one embodiment, the outsole is an outer/exterior bottom layer of the shoe system 100 that comes in direct contact with the ground when the shoe system 100 is being worn by the wearer.

In one embodiment, the outsole may be made of a different color than the midsole and the insole. In one embodiment, the insole, midsole and outsole may be made of the same color. In one embodiment, the outsole may be made of a different material than the midsole and the insole. In one embodiment, the insole, midsole and outsole may be made of the same material.

In one embodiment, the outsole includes a surface that comes in direct contact with the ground when the shoe system 100 is being worn by the wearer. In one embodiment, the surface of the outsole include one or more grip formations (e.g., undulations, ridges, grooves or other textured formations) for providing enhanced traction against smooth or wet ground surfaces. In one embodiment, the flocking procedure (as described above) may be used to create areas on the sole 102 of the shoe system 100 that enable the wearer to spin or slide more easily on the ground surfaces to perform their dance moves. In another embodiment, the outsole is made of a material having a higher coefficient of friction. In one embodiment, the surface of the outsole may include a decorative pattern formed thereon. For example, the decorative pattern may include one or more decorative elements or members. In one embodiment, the surface of the outsole may include shoe system identifier information formed thereon. For example, the shoe system identifier information may include logo information, style information, model information, brand information, size information, etc. of the shoe system 100.

In one embodiment, the outsole may include a first portion formed of a first color material and a second portion formed of a second color material. In one embodiment, the shoe system identifier information may be formed of the second color material and disposed on the first portion of the outsole. In one embodiment, the one or more decorative elements or members may be formed of the first color material and disposed on the second portion of the outsole. In one embodiment, the outsole can be of any color. In one embodiment, the first and second portions of the outsole can be of any color.

Figure 7:
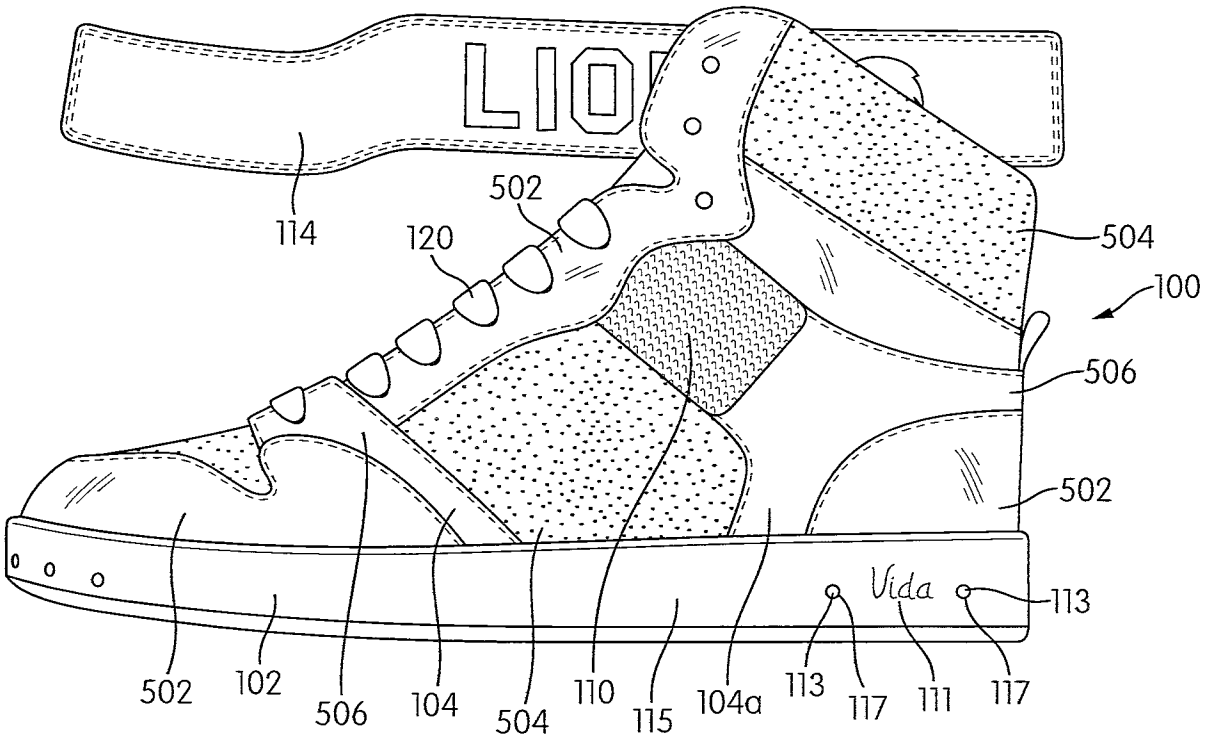
FIGS. 7 and 8 show a right and a left side elevational views, respectively of a left shoe system of FIG. 6, wherein removable and printable connector strap of the shoe system is removed from and positioned adjacent to the shoe system, and wherein top plan views of the removable and printable connector strap are also shown in FIGS. 7 and 8.
Figure 8:
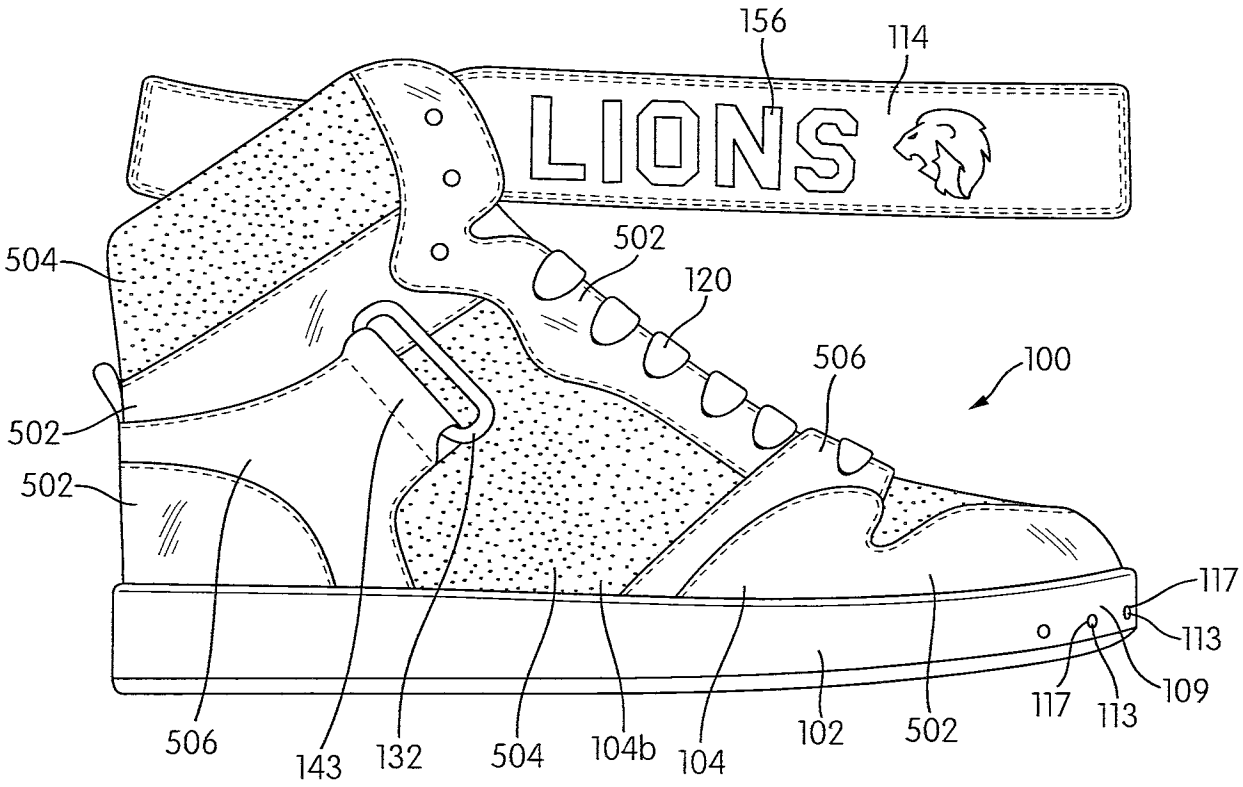
Figure 9A:
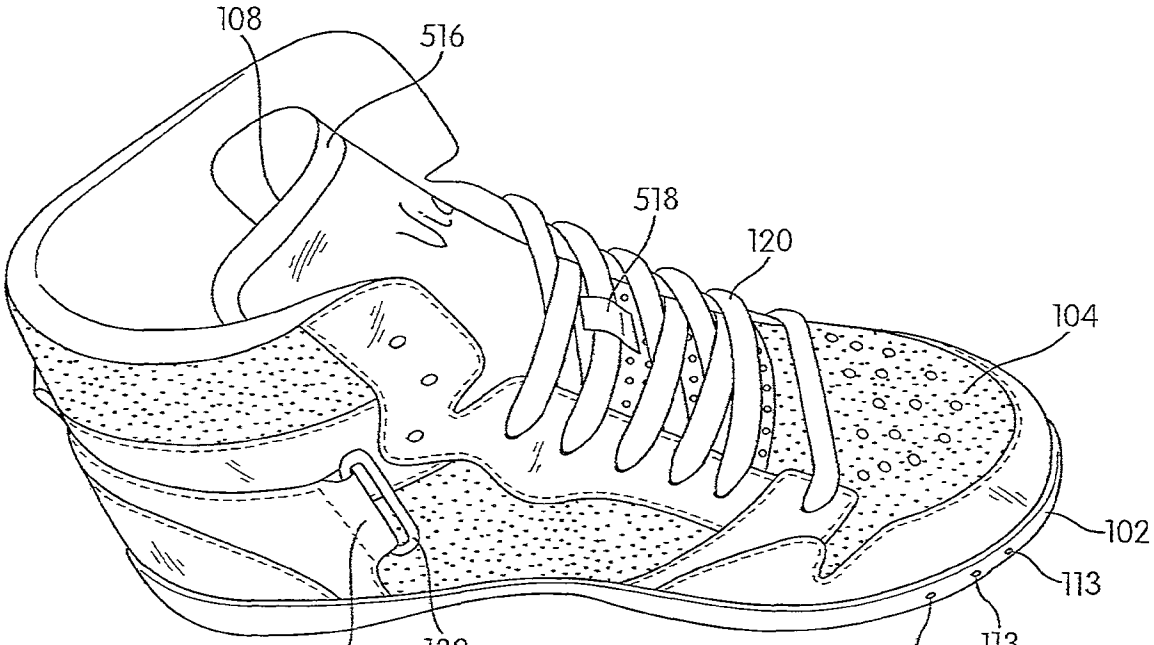
FIGS. 9A and 10A show left side perspective views of the left shoe system of FIG. 6, wherein removable and printable connector strap of the shoe system is removed from and positioned adjacent to the shoe system.
Figure 9B:
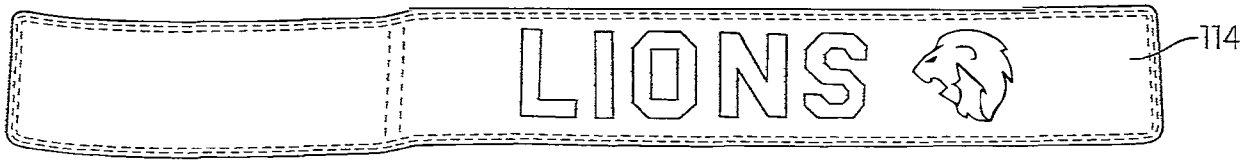
FIGS. 9B and 10B show a top and bottom plan views, respectively of the removable and printable connector strap.

In one embodiment, as shown in FIG. 7, exposed, circumferential side surface(s) 115 of the midsole may include shoe system identifier information 111 formed thereon. In one embodiment, additional decorative elements 113 may be used to decorate the exposed, circumferential side surfaces 115 of the midsole. For example, such additional decorative elements may be attached or connected to the exposed, circumferential side surfaces 115 of the midsole by any attachment or connection mechanisms as would be appreciated by one skilled in the art. In one embodiment, the additional decorative elements may be formed of different materials, such as, plastic, leather, metal, etc. and may have different colors. In one embodiment, the additional decorative elements may include studs, spikes, jewels (stones or beads), grommets, etc. For example, in one embodiment, one or more decorative jewels (stones or beads) 113 may be positioned in holes 117 formed on the exposed, circumferential side surfaces 115 and attached to the midsole. In one embodiment, as shown in FIG. 8, one or more decorative jewels (stones or beads) 113 may be positioned (and attached) in holes 117 formed on the exposed, circumferential front surfaces 109 of the midsole.

In one embodiment, the shoe upper 104 is configured to hold the shoe system 100 onto the wearer's foot. In one embodiment, the shoe upper 104 may be made of leather, canvas, a synthetic material, such as vinyl, a synthetic fabric such as a woven or a non-woven nylon fabric, etc.

In one embodiment, the shoe upper 104 may be connected to the sole 102 using a connection that runs along the perimeter of the sole 102. In one embodiment, the connection may include a strip of leather, rubber, or plastic that is stitched between the sole 102 and the shoe upper 104. In another embodiment, the shoe upper 104 may be directly connected to the sole 102 using stitches, adhesive, heat welding or any other attachment mechanism as would be appreciated by one skilled in the art. In one embodiment, the shoe upper 104 and the sole 102 may be formed by an injection molding procedure.

In one embodiment, the shoe upper 104 includes the first upper portion 104*a* and the second upper portion 104*b*. In one embodiment, the first and the second upper portions 104*a* and 104*b* of the shoe upper 114 may be referred to as the left and right shoe upper portions (not necessarily in that order). In one embodiment, the gap 106 is disposed between the first upper portion 104*a* and the second upper portion 104*b*.

Figure 6:
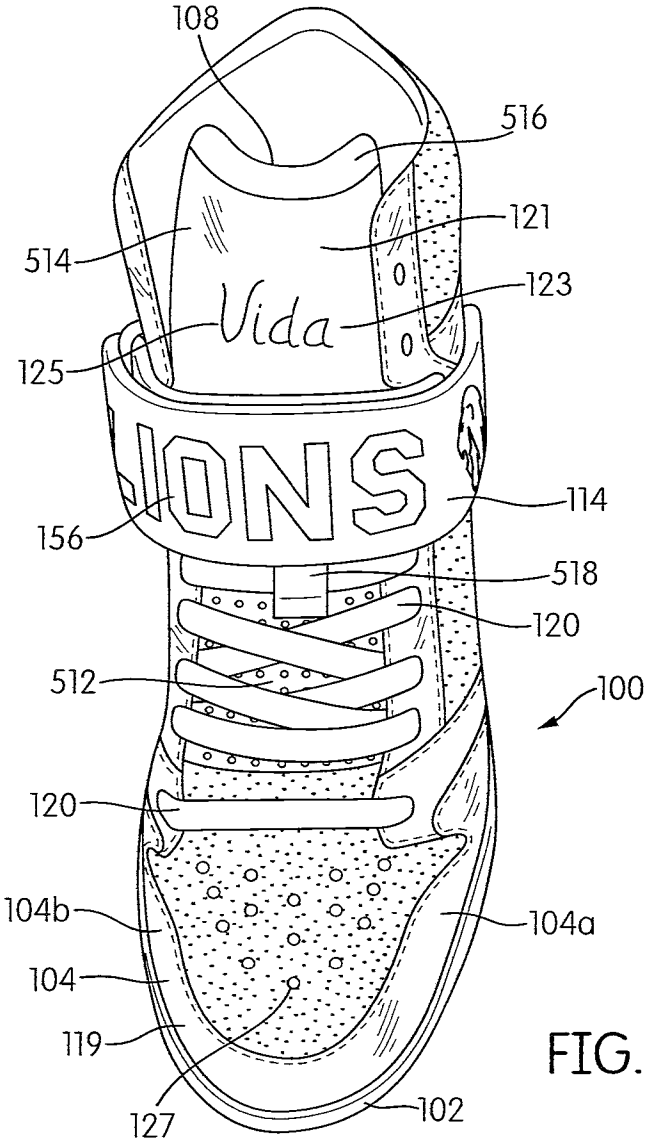
FIG. 6 shows a front perspective view of a shoe system in accordance with another embodiment of the present patent application.

In one embodiment, exterior, exposed surfaces 119 of the shoe upper 104 may include the shoe system identifier information formed thereon. In one embodiment, the exterior, exposed surfaces 119 of the shoe upper 104 may include decorative patterns formed thereon or decorative elements attached thereto. In one embodiment, the shoe upper 104 may include one or more portions with perforated holes formed therein. In one embodiment, the perforated holes are optional. For example, as shown in FIG. 6, perforated holes 127 are formed on the shoe upper 104. In one embodiment, referring to FIGS. 6 and 7, the shoe upper 104 may include one or more portions 502 made of patent leather (i.e., a very glossy, shiny finish material). In one embodiment, the patent leather is optional. In one embodiment, referring to FIGS. 6 and 7, the shoe upper 104 may include one or more portions 504 having glitter thereon. In one embodiment, the glitter is optional. In one embodiment, referring to FIGS. 6 and 7, the shoe upper 104 may include one or more portions 506 having pebbled, grained or roughened surface finish. In one embodiment, the shoe upper 104 may include one or more portions having a combination of glitter, roughened surface finish and patent leather. In one embodiment, one or more portions with glitter, one or more portions with patent leather and/or one or more portions with pebbled, grained or roughened surface finish are configured to present an appealing contrast to the shoe system 100.

In one embodiment, the first and second permanent connectors 110 and 112 may be permanently connected to the first and second upper portions 104*a* and 104*b*, respectively of the shoe upper 104 using sewing or stitching, adhesive bonding, heat welding, or a combination thereof. In one embodiment, the first and second permanent connectors 110 and 112 may be permanently connected to the first and second upper portions 104*a* and 104*b*, respectively of the shoe upper 104 by punching the first and second permanent connectors 110 and 112 into the shoe upper 104. In one embodiment, the first permanent connector 110 comprises a portion of hook or loop material permanently connected to the first upper portion 104*a* and the second permanent connector 112 comprises a portion of hook or loop material permanently connected to the second upper portion 104*b*.

In one embodiment, the first and second permanent connectors 110 and 112 both comprise hook materials that are releasably connectable with loop materials of the first and second releasable connector portions 116 and 118 of the removable and printable connector strap 114. In another embodiment, the first and second permanent connectors 110 and 112 both comprise loop materials that are releasably connectable with hook materials of the first and second releasable connector portions 116 and 118 of the removable and printable connector strap 114. In yet another embodiment, the first permanent connector 110 comprises one of the hook and loop materials that is releasably connectable with other of the hook and loop materials of the first releasable connector portion 116, while the second permanent connector 112 comprises the other of the hook or loop materials that is releasably connectable with the corresponding hook and loop materials of the second releasable connector portion 118.

In one embodiment, the first and second permanent connectors 110 and 112 each have a width $W_0$ (as shown in FIGS. 2A-3C) of at least ¾ inch. In one embodiment, the first and second permanent connectors 110 and 112 each may have a width $W_c$ of at least 1.0 inch. In one embodiment, the first and second permanent connectors 110 and 112 each may have a width $W_c$ of at least 1.25 inches. In one embodiment, the first and second permanent connectors 110 and 112 each may have a width $W_c$ of at least 1.5 inches. In one embodiment, the first and second permanent connectors 110 and 112 each may have a width $W_c$ in the leg to toe direction of about 2.0 inches. In one embodiment, the width $W_c$ of the first and second permanent connectors 110 and 112 are same as width $W_s$ (as described in detail below) of the first and second releasable connector portions 116 and 118 of the removable and printable connector strap 114.

In one embodiment, the first and second permanent connectors 110 and 112 each have a length $L_c$ (as shown in FIGS. 2A-3C) of at least ¾ inch. In one embodiment, the first and second permanent connectors 110 and 112 each may have a length $L_c$ of at least 1.0 inch. In one embodiment, the first and second permanent connectors 110 and 112 each may have a length $L_c$ of at least 1.5 in. In one embodiment, the first and second permanent connectors 110 and 112 each may have a length $L_c$ of about 1.7 inches.

In one embodiment, the first and second permanent connectors 110 and 112 each cover a surface area of at least 1.0 inch. In another embodiment the first and second permanent connectors 110 and 112 each cover a surface area of at least 1.5 inches. In another embodiment the first and second permanent connectors 110 and 112 each cover a surface area of at least 2.0 inches.

In one embodiment, as shown in and explained in detail with respect to FIGS. 8-11, the first permanent connector 110 comprises a portion of hook or loop material permanently connected to the first upper portion 104*a* and the second permanent connector 112 comprises a ring 132 through which the removable and printable connector strap 114 passes.

In one embodiment, as shown in FIGS. 4A-5C, the first upper portion 104*a* and the second upper portion 104 *b* of the shoe upper 104 have upper edge portions 510 *a* and 510 *b*. In one embodiment, the first permanent connector 110 of the first upper portion 104 *a* is positioned at a first predetermined distance A from the edge portion 510 *a* of the first upper portion 104 *a* and the second permanent connector 112 of the second upper portion 104 *b* is positioned at a second predetermined distance B from the edge portion 510 *b* of the second upper portion 104 *b*.

In one embodiment, the first predetermined distance A and the second predetermined distance B may each range between 0.2 and 2.2 inches. In one embodiment, the first predetermined distance A and the second predetermined distance B may each range between 0.5 and 2 inches. In one embodiment, the first predetermined distance A and the second predetermined distance B may each be 0.5 inches. In another embodiment, the first predetermined distance A and the second predetermined distance B may each be 2 inches, for example, when the shoe system is a high-ankle fashion shoes.

In one embodiment, as shown in FIGS. 4A-5C, the first upper portion 104*a* and the second upper portion 104 *b* of the shoe upper 104 have edge portions 510 *c* and 510 *d*.

In one embodiment, at least a portion of the first permanent connector 110 of the first upper portion 104*a* is positioned at a predetermined distance from the edge portion 510*c*. In one embodiment, the predetermined distance is at least 1.0 inch. That is, in one embodiment, at least some of the first permanent connector 110 is positioned more than an inch from the edge portion 510*c*. In one embodiment, the predetermined distance is at least 1.5 inches. In one embodiment, the predetermined distance is at least 2 inches. In one embodiment, the predetermined distance is at least 2¼ inches. In one embodiment, the predetermined distance is approximately 2⅓ inches.

In one embodiment, at least a portion of the second permanent connector 112 of the second upper portion 104*b* is positioned at a predetermined distance from the edge portion 510*d*. In one embodiment, the predetermined distance is at least 1.0 inch. That is, in one embodiment, at least some of the second permanent connector 112 is positioned more than an inch from the edge portion 510*d*. In one embodiment, the predetermined distance is at least 1.5 inches. In one embodiment, the predetermined distance is at least 2 inches. In one embodiment, the predetermined distance is at least 2¼ inches. In one embodiment, the predetermined distance is approximately 2⅓ inches.

In one embodiment, the shoe system 100 includes the tongue 108 that is below the shoe upper 104 and at least partially spanning the gap 106 between the first upper portion 104*a* and the second upper portion 104*b* of the shoe upper 104. In one embodiment, the tongue 108 is fixedly attached to the shoe upper 104 at one (or lower) end thereof and is free at the other (or upper) end thereof.

In one embodiment, the tongue 108 may include a first layer having an outwardly facing surface 121 (as shown in FIG. 6) and a second layer having an inwardly facing surface. In one embodiment, the inwardly facing surface of the tongue is configured to engage the wearer's foot when the shoe system 100 is being worn by the wearer.

In one embodiment, the first layer of the tongue 108 may be made of leather, canvas, a synthetic material, such as vinyl, a synthetic fabric such as a woven or a non-woven nylon fabric, etc. In one embodiment, the outwardly facing surface 121 (as shown in FIG. 6) of the tongue 108 may include one or more portions 512 with perforated holes formed therein. In one embodiment, the perforated holes are optional. In one embodiment, the outwardly facing surface 121 of the tongue 108 may include one or more portions 514 having patent leather (i.e., a very glossy, shiny finish material). In one embodiment, the patent leather is optional. In one embodiment, the outwardly facing surface 121 of the tongue 108 may include one or more portions having glitter. In one embodiment, the glitter is optional. In one embodiment, the outwardly facing surface 121 of the tongue 108 may include one or more portions having a combination of glitter and patent leather. For example, as shown in FIG. 6, the outwardly facing surface 121 of the tongue 108 may include one or more portions 123 having a combination of glitter and patent leather.

In one embodiment, the outwardly facing surface 121 of the tongue 108 may include a decorative pattern formed thereon. For example, the decorative pattern may include one or more decorative elements or members. In one embodiment, the outwardly facing surface 121 of the tongue 108 may include shoe system identifier information formed thereon. For example, as shown in FIG. 6, shoe system identifier information 125 formed on the outwardly facing surface 121 of the tongue 108.

In one embodiment, the second layer of the tongue 108 may be made of a breathable or perforated material. In one embodiment, the second layer of the tongue 108 may be made of a synthetic fabric such as a woven or a non-woven nylon fabric.

In one embodiment, the first and second layers of the tongue 108 may be connected to each other by stitches or by any other attachment/connection mechanisms as would be appreciated by one skilled in the art. In one embodiment, a layer of padding or stuffing material is positioned between the first and second layers of the tongue 108 to provide enhanced comfort to the wearer of the shoe system 100. For example, the padding or stuffing material may be made of polyester, fiber, foam, cotton, or other material. In one embodiment, the layer of padding or stuffing material is optional. In one embodiment, as shown in FIG. 6, the tongue 108 may include a decorative border 516 that is formed of a contrasting color (compared to the outwardly facing surface 121 of the tongue 108).

In one embodiment, as shown in FIG. 6, the tongue 108 may include one or more lace holders 518 thereon that are configured to allow the shoe laces 120 to pass therethrough so as to secure the tongue 108 from lateral or longitudinal movement. In one embodiment, the lace holders 518 are positioned on the outwardly facing surface 121 of the tongue 108.

In one embodiment, when the shoe system 100 is devoid of laces, the shoe system 100 may include one or more tongue (lateral or longitudinal) movement limiting members. In one embodiment, one end of the tongue movement limiting member is connected to a portion of the tongue 108 and the other end of the tongue movement limiting member is connected to the sole 102 (e.g., insole) of the shoe system 100. In one embodiment, the shoe system 100 may include two tongue movement limiting members, each positioned on the opposite sides of the tongue 108 to secure the tongue 108 from lateral or longitudinal movement.

In one embodiment, as shown in the embodiments of FIGS. 6-12B and 13A-16, the shoe system 100 includes the shoe laces or strings 120 that are generally used to secure the shoe system 100. In one embodiment, the shoe laces or strings 120 generally pass through a series of lace holding or receiving elements (e.g., holes, eyelets, loops or hooks) positioned or formed on the either side of the shoe upper 104. For example, in one embodiment, the shoe system 104 may include nine lace holding elements on each side of the shoe upper 104 that are configured to receive the shoe laces or strings 120. In one embodiment, the shoe system 104 may include six lace holding elements on each side of the shoe upper 104 that are configured to receive the shoe laces or strings 120. In one embodiment, the number of lace holding elements may vary and the type of the lace receiving elements (e.g., holes, eyelets, loops or hooks) may vary.

In one embodiment, as shown in FIGS. 1A-5C, the shoe system 100 is devoid of shoe laces or strings. In one embodiment, as shown in FIGS. 1A-5C, the shoe system 100 may include a shoe fastening/closure strap 122 that is constructed and arranged to loosen or tighten the shoe system 100. In one embodiment, one end of the shoe fastening/closure strap 122 is permanently attached to one of the first or second upper portions 104 *a* or 104 *b* and the other end of the shoe fastening/closure strap 122 is releasably connected to the other of the first or second upper portions 104*a* or 104 *b*. In one embodiment, the shoe fastening/closure strap 122 may include a hook or loop material (e.g., positioned on an inwardly facing surface of the shoe fastening/closure strap 122) that is configured to be releasably connected to a loop or hook material permanently attached to one of the first and second upper portions 104 *a* or 104 *b* so as to releasably connect the shoe fastening/closure strap 122 to the shoe upper 104.

In one embodiment, as shown in FIGS. 1-5, the shoe system 100 is devoid of shoe laces or strings. In one embodiment, as shown in FIGS. 1-5, the shoe system 100 may include a shoe fastening/closure strap 122 that is constructed and arranged to loosen or tighten the shoe system 100. In one embodiment, one end of the shoe fastening/closure strap 122 is permanently attached to one of the first or second upper portions 104*a* or 104*b* and the other end of the shoe fastening/closure strap 122 is releasably connected to the other of the first or second upper portions 104*a* or 104*b*. In one embodiment, the shoe fastening/closure strap 122 may include a hook or loop material (e.g., positioned on an inwardly facing surface of the shoe fastening/closure strap 122) that is configured to be releasably connected to a loop or hook material permanently attached to one of the first and second upper portions 104*a* or 104*b* so as to releasably connect the shoe fastening/closure strap 122 to the shoe upper 104.

Figure 14:
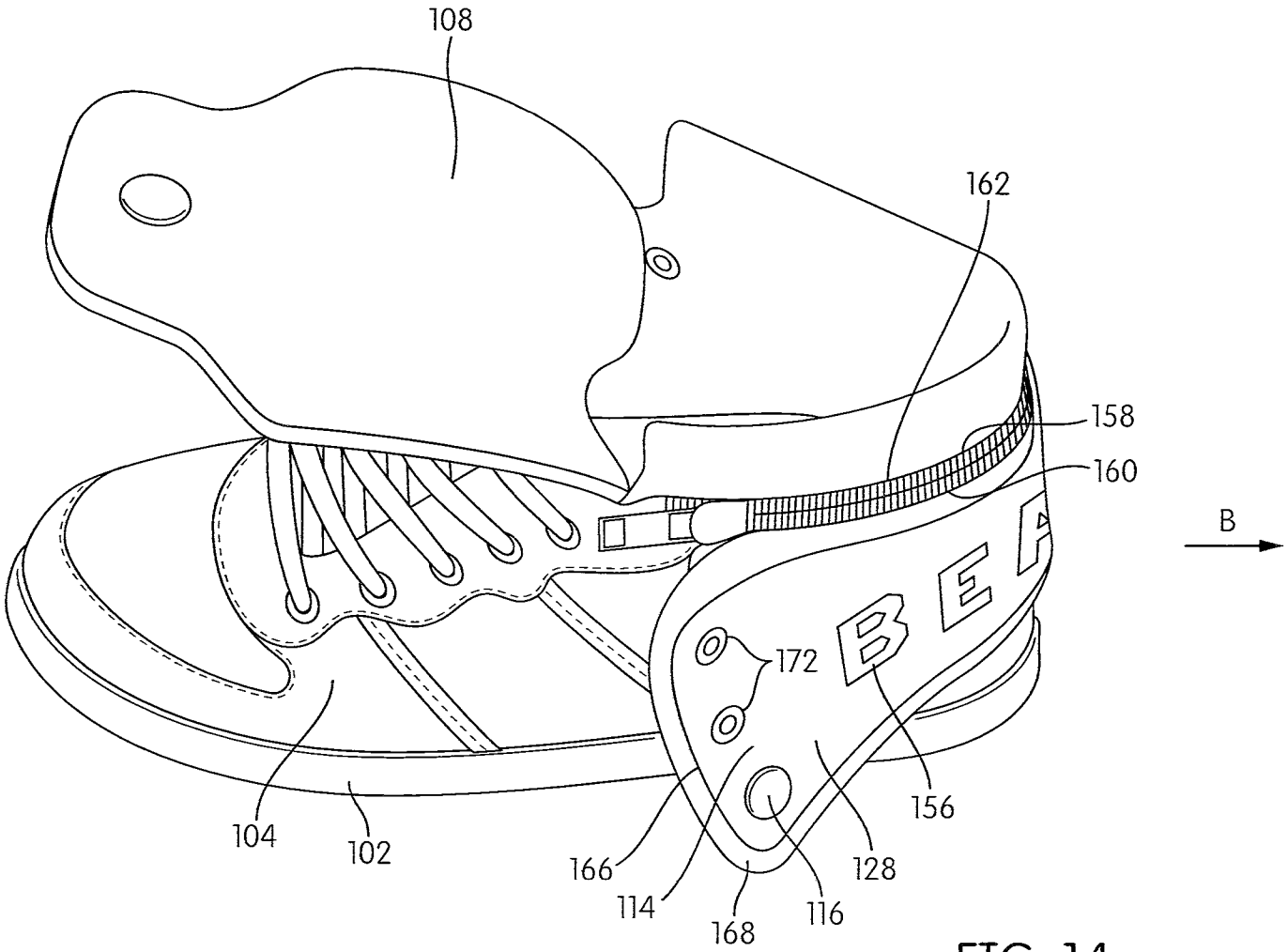
FIGS. 14 and 15 show a right side and a rear perspective views, respectively of the left shoe system of FIG. 13, wherein removable and printable connector strap of the left shoe system is being releasably connected to the left shoe system.
Figure 15:
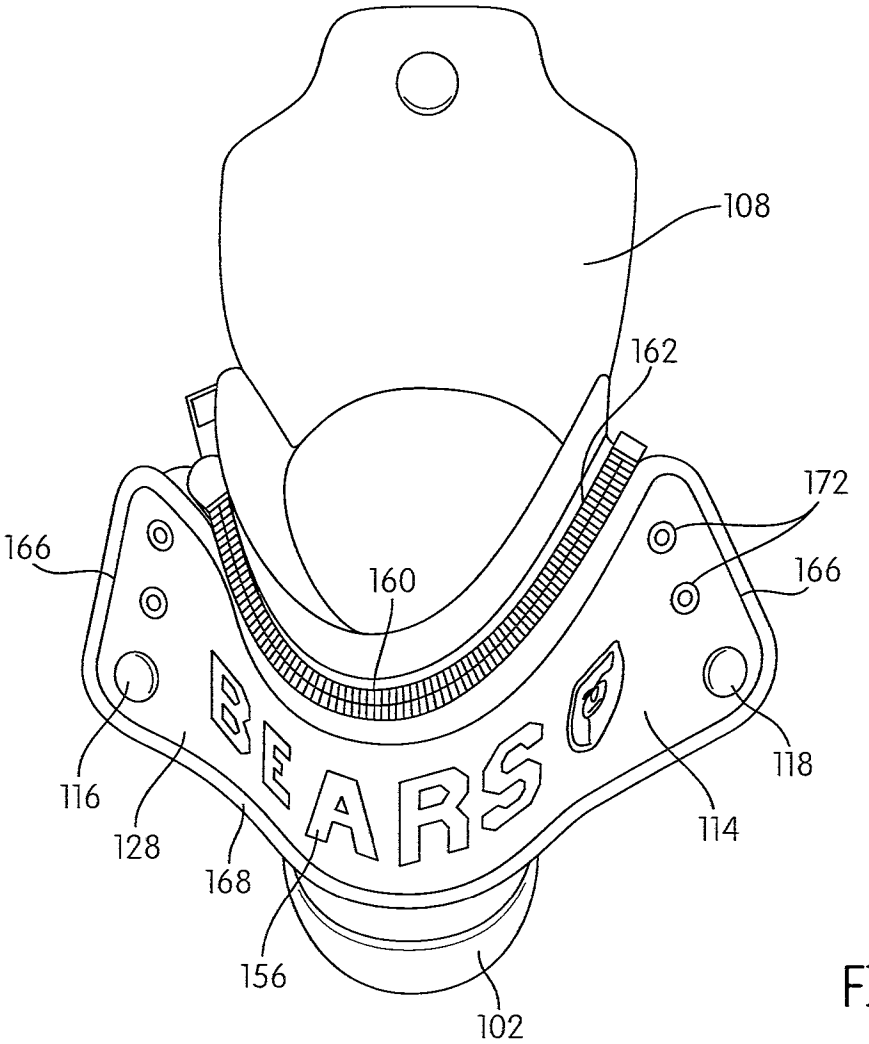

In one embodiment, the shoe system 100 may include one shoe fastening/closure strap 122 and the removable and printable connector strap 114, where the removable and printable connector strap 114 may serve as a second shoe fastening/closure strap. That is, in one embodiment, the removable and printable connector strap 114 has a functional attribute of being able to loosen or tighten the shoe system 100. In one embodiment, the shoe system 100 may include two removable and printable connector straps 114 that are configured to serve as the shoe fastening/closure straps. In one embodiment, the shoe system 100 may include two shoe fastening/closure straps 112, for example, that are not removable. In such an embodiment, the removable and printable connector strap 114 may be positioned on the shoe system 100 in an area around the wearer's ankle, for example, as shown in FIGS. 14 and 15.

In one embodiment, the removable and printable connector strap 114 is releasably connectable with the shoe upper 104. In one embodiment, the removable and printable connector strap 114 may be constructed and arranged to provide dual function of providing the printable aesthetics to the shoe system 100 and providing the ability to loosen or tighten the shoe system 100. For example, in one embodiment, when the shoe system 100 is devoid of shoe laces, the removable and printable connector strap 114 is adjustably connected to the first permanent connector 110 to adjust the gap 106 between the first upper portion 104*a* and the second upper portion 104*b* and hence the tightness of the shoe system 100 on the wearers foot.

In one embodiment, at least one of the first releasable connector portion 116 and the second releasable connector portion 118 of the removable and printable connector strap 114 is configured to be selectively adjustably connectable with or positionable along the corresponding first permanent connector 110 or second permanent connector 112 of the shoe upper 104 to allow adjustment of the shoe upper 104 and the tongue 108 around a wearer's foot. That is, this selective adjustment enables the wearer to adjust the gap 106 between the first upper portion 104*a* and the second upper portion 104*b* and hence either tighten or loosen the shoe system 108.

In one embodiment, at least one of the first releasable connector portion 116 and the second releasable connector portion 118 of the removable and printable connector strap 114 is configured to be selectively adjustably connectable with the corresponding first or second permanent connectors 110 or 112 of the shoe upper 104 at varying lengths to adjust the gap 106 between the first upper portion 104*a* and the second upper portion 104*b*. In one embodiment, this selective adjustment also adjusts a tension to be applied in the shoe upper 104 so as to cause either tightening or loosening of the shoe upper 104 around the wear's foot. For example, the amount of overlap of at least one of the first and second releasable connector portions 116 and 118 with their corresponding first or second permanent connectors 110 is adjustable for accommodating different sized or width feet of different wearers. That is, the wearer may select the amount of overlap of at least one of the first and second releasable connector portions 116 and 118 on their corresponding first or second permanent connectors 110. The amount of overlap thus enables the wearer to accommodate his actual foot width/size. In one embodiment, the lengths of the first releasable connector portion 116 and the second releasable connector portion 118 of the removable and printable connector strap 114 and their corresponding first or second permanent connectors 110 or 112 of the shoe upper 104 may be sufficient so that the shoe system 100 provides a wide range of adjustment for different sized or different (feet/shoe) width wearers.

In one embodiment, the removable and printable connector strap 114 includes no folds therein when the removable and printable connector strap 114 is removed from being attached from the shoe system 100. That is, in one embodiment, the removable and printable connector strap 114 has a generally planar or sheet-like configuration. In one embodiment, the removable and printable connector strap 114 has a single-ply configuration.

In one embodiment, the removable and printable connector strap 114 may be of the same color as the shoe upper 104 of the shoe system 100. In one embodiment, the removable and printable connector strap 114 may be of a different color than the shoe upper 104 of the shoe system 100. For example, in one embodiment, the removable and printable connector strap 114 may generally be of a contrasting color (compared to the shoe upper 104) to provide a desired decorative/aesthetic effect and/or visual interest to the shoe system 100.

In one embodiment, the removable and printable connector strap 114 may be formed of a perforated material. For example, in one embodiment, the removable and printable connector strap 114 may be formed of a perforated material that is similar to that used for the tongue 108 (of FIG. 6) of the shoe system 100.

In one embodiment, the removable and printable connector strap 114 has a width $W_s$ (as shown in FIG. 2) in the leg to toe direction of at least 1⅛ inch. In one embodiment, the removable and printable connector strap 114 has a width $W_s$ (as shown in FIG. 2) in the leg to toe direction is between ⅞ and 2½ inches. In one embodiment, the removable and printable connector strap 114 has a width $W_s$ (as shown in FIG. 2) in the leg to toe direction is between 1⅛ and 2 inches. In one embodiment, the removable and printable connector strap 114 has a width $W_s$ in the leg to toe direction of 15/16 inch or greater. In one embodiment, the removable and printable connector strap 114 has a width $W_s$ in the leg to toe direction of 1¼ inch or greater. In one embodiment, the removable and printable connector strap 114 has a width $W_s$ in the leg to toe direction of 1½ inch or greater. In one embodiment, the removable and printable connector strap 114 has a width. $W_s$ in the leg to toe direction of 1¾ inch or greater.

In one embodiment, as shown in FIGS. 1A-5C and 13A-16, the removable and printable connector strap 114 has a length $L_s$ (as shown in FIGS. 2A-2C) in the side to side shoe direction of at least 4½ inches. In one embodiment, the removable and printable connector strap 114 has a length $L_s$ in the side to side shoe direction between 4½ and 10 inches, and in another embodiment between 5.0 and 9.5 inches, in yet another embodiment between 5.5 and 9 inches. In another embodiment, the removable and printable connector strap 114 has a length $L_s$ in the side to side shoe direction of at least 5 inches. In one embodiment, the removable and printable connector strap 114 has a length $L_s$ in the side to side shoe direction of at least 5½ inches. In one embodiment, the removable and printable connector strap 114 has a length $L_s$ in the side to side shoe direction of at least 6 inches. In one embodiment, the removable and printable connector strap 114 has a length $L_s$ in the side to side shoe direction of at least 6½ inches. In one embodiment, the removable and printable connector strap 114 has a length. $L_s$ in the side to side shoe direction of at least 7 inches. In one embodiment, the removable and printable connector strap 114 has a length in the side to side shoe direction of at least 7½ inches. In one embodiment, the removable and printable connector strap 114 has a length $L_s$ in the side to side shoe direction of at least 8 inches. In one embodiment, the removable and printable connector strap 114 has a length $L_s$ in the side to side shoe direction of at least 8½ inches. In one embodiment, the removable and printable connector strap 114 has a length $L_s$ in the side to side shoe direction of at least 9 inches. In one embodiment, the removable and printable connector strap 114 has a length $L_s$ in the side to side shoe direction of at least 9¼ inches. In one embodiment, the removable and printable connector strap 114 has a length $L_s$ in the side to side shoe direction of at least 9½ inches. In one embodiment, the removable and printable connector strap 114 has a length $L_s$ in the side to side shoe direction of at least 9¾ inches.

In one embodiment, as shown in FIGS. 6-12B, the removable and printable connector strap 114 has a length $L_s$ in the side to side shoe direction of at least 8½ inches. In one embodiment, the length $L_s$ of the removable and printable connector strap 114 in FIGS. 6-12B is the unfolded length of the removable and printable connector strap 114. In one embodiment, the removable and printable connector strap 114 has a length $L_s$ in the side to side shoe direction between 7 and 20 inches, in another embodiment between 7½ and 19½ inches and in yet another embodiment between 8 and 19 inches. In one embodiment, the removable and printable connector strap 114 has a length $L_s$ in the side to side shoe direction between 8½ and 12 inches, in another embodiment between 9.0 and 11.5 inches and in yet another embodiment between 9.5 and 11.0 inches. In another embodiment, the removable and printable connector strap 114 has a length. $L_s$ in the side to side shoe direction of at least 9 inches. In one embodiment, the removable and printable connector strap 114 has a length $L_s$ in the side to side shoe direction of at least 9½ inches. In one embodiment, the removable and printable connector strap 114 has a length $L_s$ in the side to side shoe direction of at least 10 inches. In one embodiment, the removable and printable connector strap 114 has a length $L_s$ in the side to side shoe direction of at least 10½ inches. In one embodiment, the removable and printable connector strap 114 has a length $L_s$ in the side to side shoe direction of at least 11 inches. In one embodiment, the removable and printable connector strap 114 has a length $L_s$ in the side to side shoe direction of at least 11½ inches. In one embodiment, the removable and printable connector strap 114 has a length $L_s$ in the side to side shoe direction of at least 12 inches. In one embodiment, the removable and printable connector strap 114 has a length $L_s$ in the side to side shoe direction of at least 12½ inches. In one embodiment, the removable and printable connector strap 114 has a length $L_s$ in the side to side shoe direction of at least 17 inches. In one embodiment, the removable and printable connector strap 114 has a length $L_s$ in the side to side shoe direction of at least 17½ inches. In one embodiment, the removable and printable connector strap 114 has a length $L_s$ in the side to side shoe direction of at least 18 inches. In one embodiment, the removable and printable connector strap 114 has a length $L_s$ in the side to side shoe direction of at least 18½ inches. In one embodiment, the removable and printable connector strap 114 has a length $L_s$ in the side to side shoe direction of at least 19 inches. In one embodiment, the removable and printable connector strap 114 has a length $L_s$ in the side to side shoe direction of at least 19¼ inches. In one embodiment, the removable and printable connector strap 114 has a length $L_s$ in the side to side shoe direction of at least 19½ inches. In one embodiment, the removable and printable connector strap 114 has a length $L_s$ in the side to side shoe direction of at least 19¾ inches.

In one embodiment, the length $L_s$ (in the side to side shoe direction) and the width $W_s$ (in the leg to toe direction) of the removable and printable connector strap 114 may vary and may depend on the shoe size of the wearers.

In one embodiment, the removable and printable connector strap 114 has a thickness between 3/32 and 3/8 inch. In one embodiment, the removable and printable connector strap 114 has a thickness of at least 1/8 inch. In one embodiment, the removable and printable connector strap 114 has a thickness of at least 5/32 inch. In one embodiment, the removable and printable connector strap 114 has a thickness of at least 3/16 inch. In one embodiment, the removable and printable connector strap 114 has a thickness of at least 1/4 inch. In one embodiment, the removable and printable connector strap 114 has a thickness of at least 5/16 inch. In one embodiment, the thickness of the removable and printable connector strap 114 includes the thickness of the first releasable connector portion 116 and the second releasable connector portion 118.

FIGS. 18A-20D show removable and printable connector straps for different sized shoe systems in accordance with different embodiments of the present patent application. The length $L_s$ (in the side to side shoe direction) and width $W_s$ (in the leg to toe direction) of the removable and printable connector strap are shown in each of the FIGS. 18A-20D in millimeters (mms). The removable and printable connector straps in FIGS. 18A-20D are not drawn to scale and have been enlarged for sake of clarity.

Figure 18C:
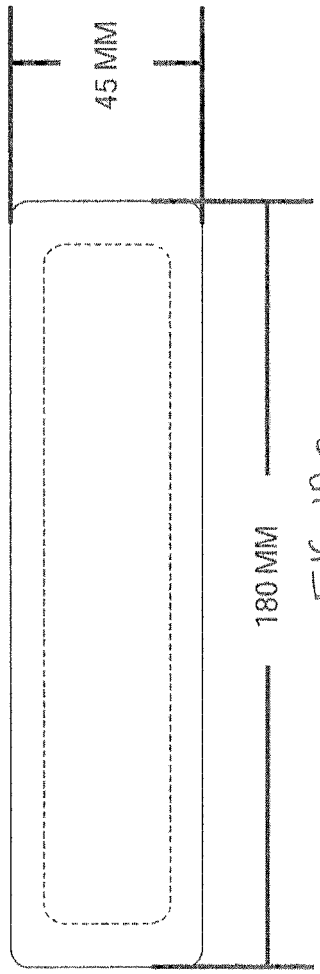
Figure 18D:
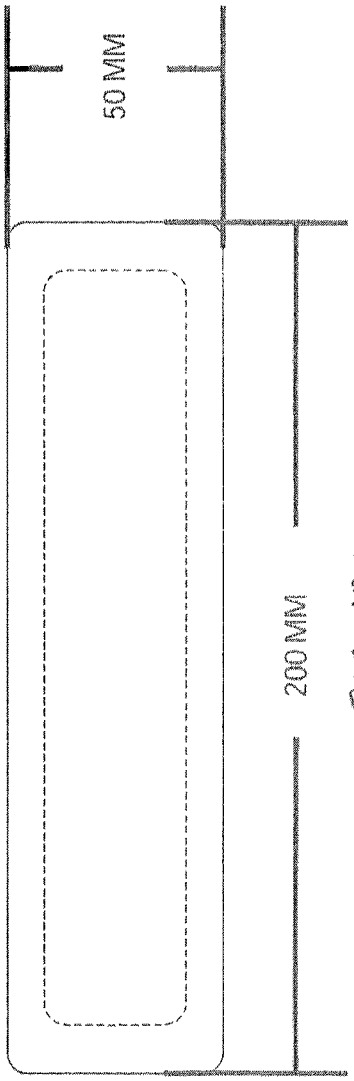
Figure 19A:
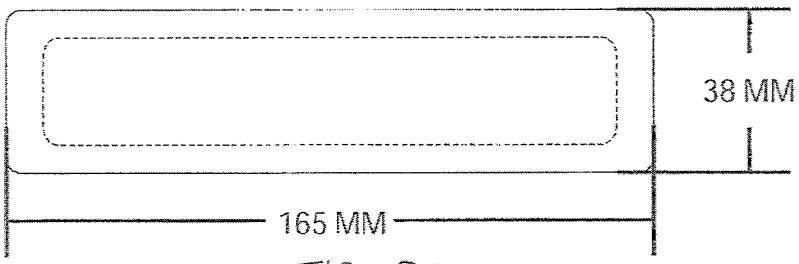
FIGS. 19A-19D show removable and printable connector straps for different sized shoe systems in accordance with another embodiment of the present patent application.
Figure 19B:
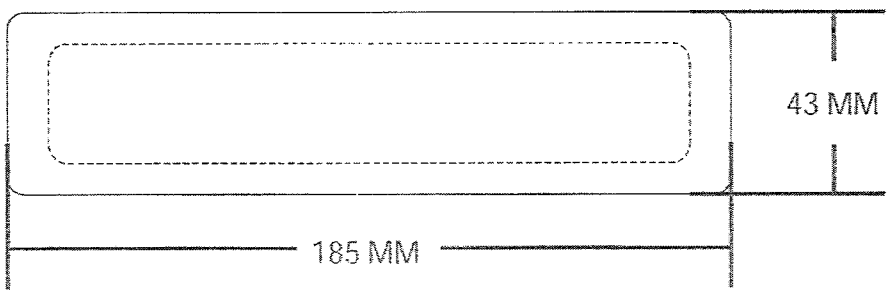
Figure 19C:
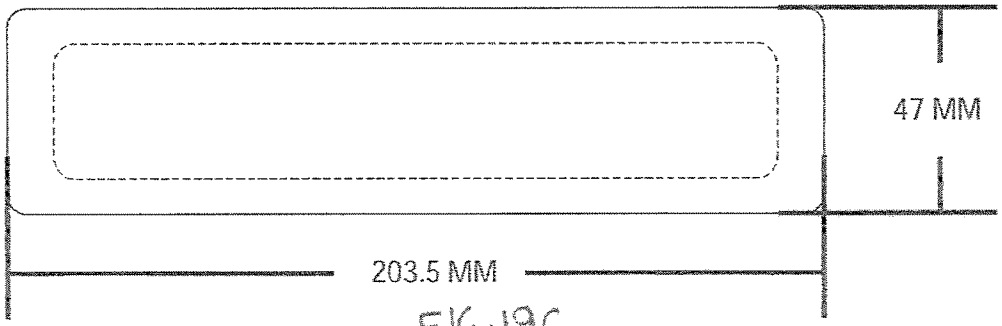
Figure 19D:
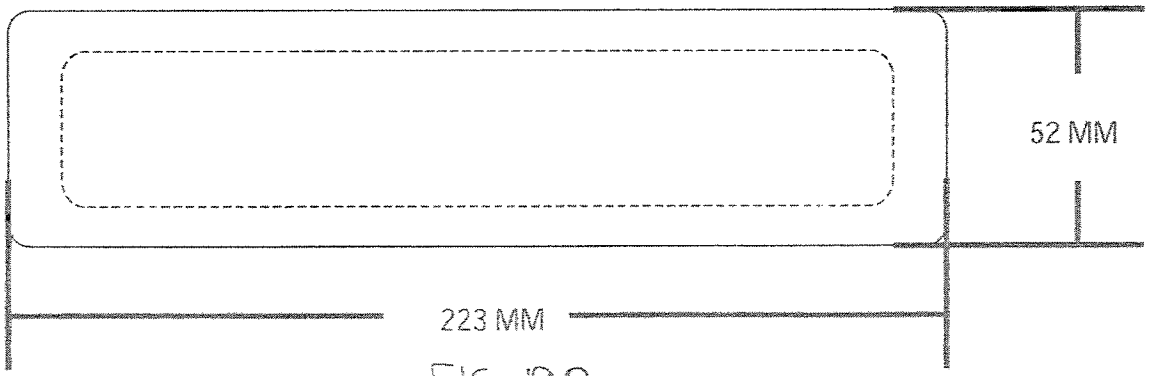
Figure 20A:
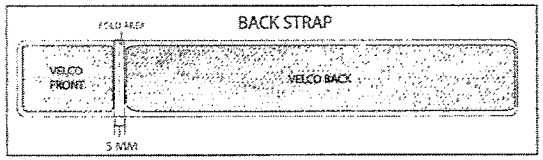
FIGS. 20A-20D show removable and printable connector straps for different sized shoe systems in accordance with yet another embodiment of the present patent application.
Figure 20A:
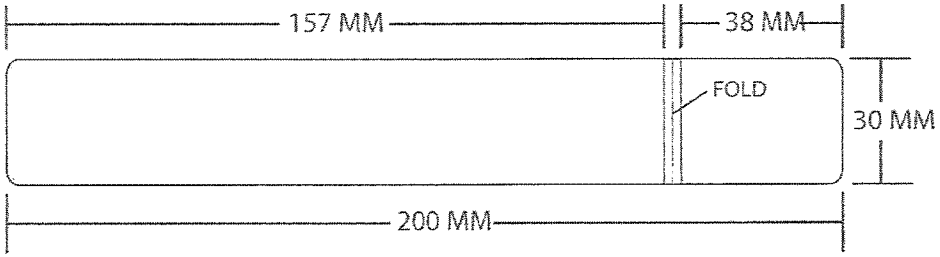
Figure 20B:
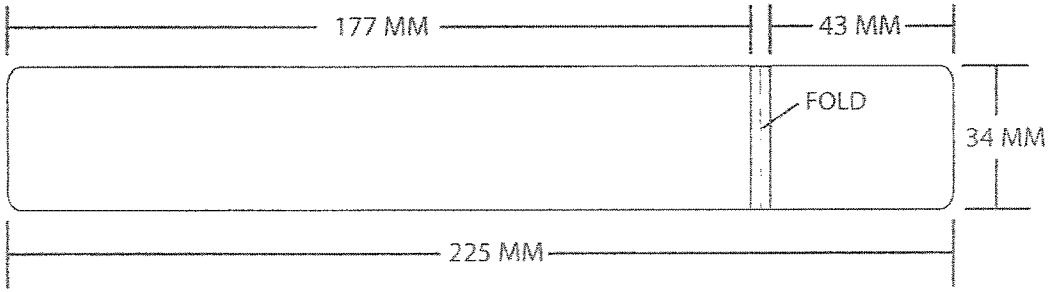
Figure 20C:
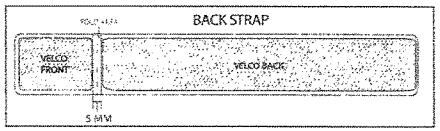
Figure 20C:
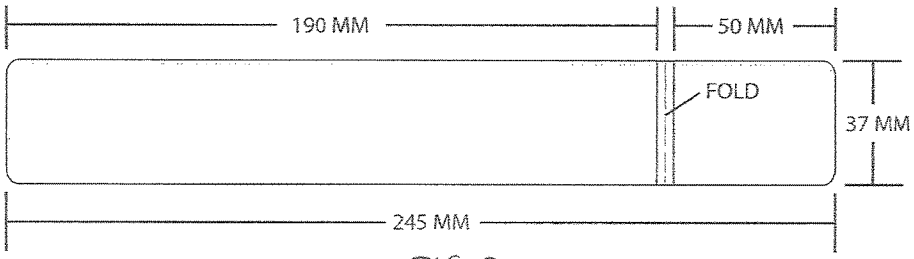
Figure 20D:
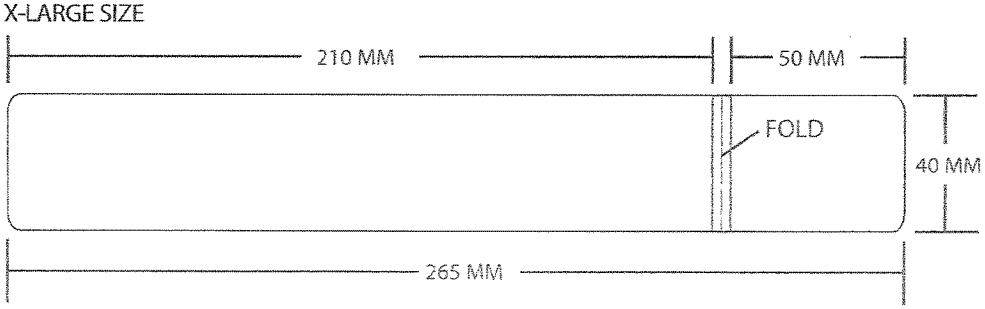

For example, FIGS. 18A, 19A and 20A show the removable and printable connector straps 114 for the three different shoe system models, respectively each shoe system model includes kid's US shoe sizes 10-13 (i.e., 16.1-19.1 centimeters (cms)), FIGS. 18B, 19B and 20B show the removable and printable connector straps 114 for the three different shoe system models, respectively and each shoe system model includes kid's US shoe sizes 1-3 (i.e., 19.7-21.6 cms) and women's US shoe sizes 5-5.5 (i.e., 21.6-22.2 cms), FIGS. 18C, 19C and 20C show the removable and printable connector straps 114 for the three different shoe system models, respectively and each shoe system model includes women's US shoe sizes 6-9 (i.e., 215-25.1 cms), and FIGS. 18D, 19D and 20D show the removable and printable connector straps 114 for the three different shoe system models, respectively and each shoe system model includes women's US shoe sizes 10-13 (i.e., 25.9-27.9 cms).

FIG. 21 shows a table with shoe/shoe system sizing information. Specifically, the table of FIG. 21 shows kid's US shoe sizes, for example, from 10 to 3 and women's US shoe sizes, for example, from 5 to 13. The table also shows corresponding length of the shoe/shoe system (e.g., in the leg to toe direction) for each shoe/shoe system size. The length of the shoe/shoe system (e.g., in the leg to toe direction) is shown in centimeters in the table of FIG. 21.

In one embodiment, referring to FIGS. 18A-19D, a ratio of the length $L_s$ (in the side to side shoe direction) of the removable and printable connector strap to the length of the shoe/shoe system (e.g., in the leg to toe direction) generally ranges between 0.58 and 1.22. In one embodiment, a ratio of the length $L_s$ (in the side to side shoe direction) of the removable and printable connector strap to the length of the shoe/shoe system (e.g., in the leg to toe direction) generally ranges between 0.72 and 1.02.

In one embodiment, a ratio of the length $L_s$ (in the side to side shoe direction) of the removable and printable connector strap to the length of the shoe/shoe system (e.g., in the leg to toe direction) generally ranges between 0.73 and 0.87. In one embodiment, a ratio of the length $L_s$ (in the side to side shoe direction) of the removable and printable connector strap to the length of the shoe/shoe system (e.g., in the leg to toe direction) generally ranges between 0.72 and 0.81. In one embodiment, a ratio of the length $L_s$ (in the side to side shoe direction) of the removable and printable connector strap to the length of the shoe/shoe system (e.g., in the leg to toe direction) generally ranges between 0.72 and 0.77. In one embodiment, a ratio of the length $L_s$ (in the side to side shoe direction) of the removable and printable connector strap to the length of the shoe/shoe system (e.g., in the leg to toe direction) generally ranges between 0.72 and 0.8. In one embodiment, a ratio of the length $L_s$ (in the side to side shoe direction) of the removable and printable connector strap to the length of the shoe/shoe system (e.g., in the leg to toe direction) generally ranges between 0.86 and 1.02. In one embodiment, a ratio of the length $L_s$ (in the side to side shoe direction) of the removable and printable connector strap to the length of the shoe/shoe system (e.g., in the leg to toe direction) generally ranges between 0.83 and 0.94. In one embodiment, a ratio of the length $L_s$ (in the side to side shoe direction) of the removable and printable connector strap to the length of the shoe/shoe system (e.g., in the leg to toe direction) generally ranges between 0.81 and 0.9. In one embodiment, a ratio of the length $L_s$ (in the side to side shoe direction) of the removable and printable connector strap to the length of the shoe/shoe system (e.g., in the leg to toe direction) generally ranges between 0.8 and 0.86.

In one embodiment, referring to FIGS. 18A-19D, a ratio of the width $W_s$ (in the leg to toe direction) of the removable and printable connector strap to the length of the shoe/shoe system (e.g., in the leg to toe direction) generally ranges between 0.14 and 0.28. In one embodiment, a ratio of the length $L_s$ (in the side to side shoe direction) to the length of the shoe/shoe system (e.g., in the leg to toe direction) generally ranges between 0.18 and 0.24.

In one embodiment, a ratio of the width $W_s$ (in the leg to toe direction) of the removable and printable connector strap to the length of the shoe/shoe system (e.g., in the leg to toe direction) generally ranges between 0.19 and 0.22. In one embodiment, a ratio of the length $L_s$ (in the side to side shoe direction) to the length of the shoe/shoe system (e.g., in the leg to toe direction) generally ranges between 0.18 and 0.21. In one embodiment, a ratio of the width $W_s$ (in the leg to toe direction) of the removable and printable connector strap to the length of the shoe/shoe system (e.g., in the leg to toe direction) generally ranges between 0.18 and 0.19. In one embodiment, a ratio of the length $L_s$ (in the side to side shoe direction) to the length of the shoe/shoe system (e.g., in the leg to toe direction) generally ranges between 0.18 and 0.2. In one embodiment, a ratio of the width $W_s$ (in the leg to toe direction) of the removable and printable connector strap to the length of the shoe/shoe system (e.g., in the leg to toe direction) generally ranges between 0.19 and 0.24. In one embodiment, a ratio of the length $L_s$ (in the side to side shoe direction) to the length of the shoe/shoe system (e.g., in the leg to toe direction) generally ranges between 0.19 and 0.22. In one embodiment, a ratio of the width $W_s$ (in the leg to toe direction) of the removable and printable connector strap to the length of the shoe/shoe system (e.g., in the leg to toe direction) generally ranges between 0.19 and 0.21. In one embodiment, a ratio of the length $L_s$ (in the side to side shoe direction) to the length of the shoe/shoe system (e.g., in the leg to toe direction) generally ranges between 0.19 and 0.20.

FIGS. 18A-19D show removable and printable connector straps having structure and configuration similar to that described with respect to FIGS. 1A-5C, while FIGS. 20A-20D show removable and printable connector straps having structure and configuration similar to that described with respect to FIGS. 6-12B. That is, each removable and printable connector strap in FIGS. 20A-20B are constructed and arranged such that at least a portion thereof is folded back over itself.

In one embodiment, referring to FIGS. 20A-20D, a ratio of the length $L_s$ (in the side to side shoe direction) of the removable and printable connector strap to the length of the shoe/shoe system (e.g., in the leg to toe direction) generally ranges between 0.76 and 1.48. In one embodiment, a ratio of the length $L_s$ (in the side to side shoe direction) of the removable and printable connector strap to the length of the shoe/shoe system (e.g., in the leg to toe direction) generally ranges between 0.95 and 1.24.

In one embodiment, a ratio of the length $L_s$ (in the side to side shoe direction) of the removable and printable connector strap to the length of the shoe/shoe system (e.g., in the leg to toe direction) generally ranges between 1.05 and 1.24. In one embodiment, a ratio of the length $L_s$ (in the side to side shoe direction) of the removable and printable connector strap to the length of the shoe/shoe system (e.g., in the leg to toe direction) generally ranges between 1.01 and 1.14. In one embodiment, a ratio of the length $L_s$ (in the side to side shoe direction) of the removable and printable connector strap to the length of the shoe/shoe system (e.g., in the leg to toe direction) generally ranges between 0.98 and 1.09. In one embodiment, a ratio of the length $L_s$ (in the side to side shoe direction) of the removable and printable connector strap to the length of the shoe/shoe system (e.g., in the leg to toe direction) generally ranges between 0.95 and 1.02.

In one embodiment, referring to FIGS. 20A-20D, a ratio of the width $W_s$ (in the leg to toe direction) of the removable and printable connector strap to the length of the shoe/shoe system (e.g., in the leg to toe direction) generally ranges between 0.11 and 0.23. In one embodiment, a ratio of the width $W_s$ (in the leg to toe direction) to the length of the shoe/shoe system (e.g., in the leg to toe direction) generally ranges between 0.14 and 0.19.

In one embodiment, a ratio of the width $W_s$ (in the leg to toe direction) of the removable and printable connector strap to the length of the shoe/shoe system (e.g., in the leg to toe direction) generally ranges between 0.16 and 0.19. In one embodiment, a ratio of the width $W_s$ (in the leg to toe direction) to the length of the shoe/shoe system (e.g., in the leg to toe direction) generally ranges between 0.15 and 0.17. In one embodiment, a ratio of the width $W_s$ (in the leg to toe direction) of the removable and printable connector strap to the length of the shoe/shoe system (e.g., in the leg to toe direction) generally ranges between 0.15 and 0.16. In one embodiment, a ratio of the width $W_s$ (in the leg to toe direction) to the length of the shoe/shoe system (e.g., in the leg to toe direction) generally ranges between 0.14 and 0.15.

Figure 4:
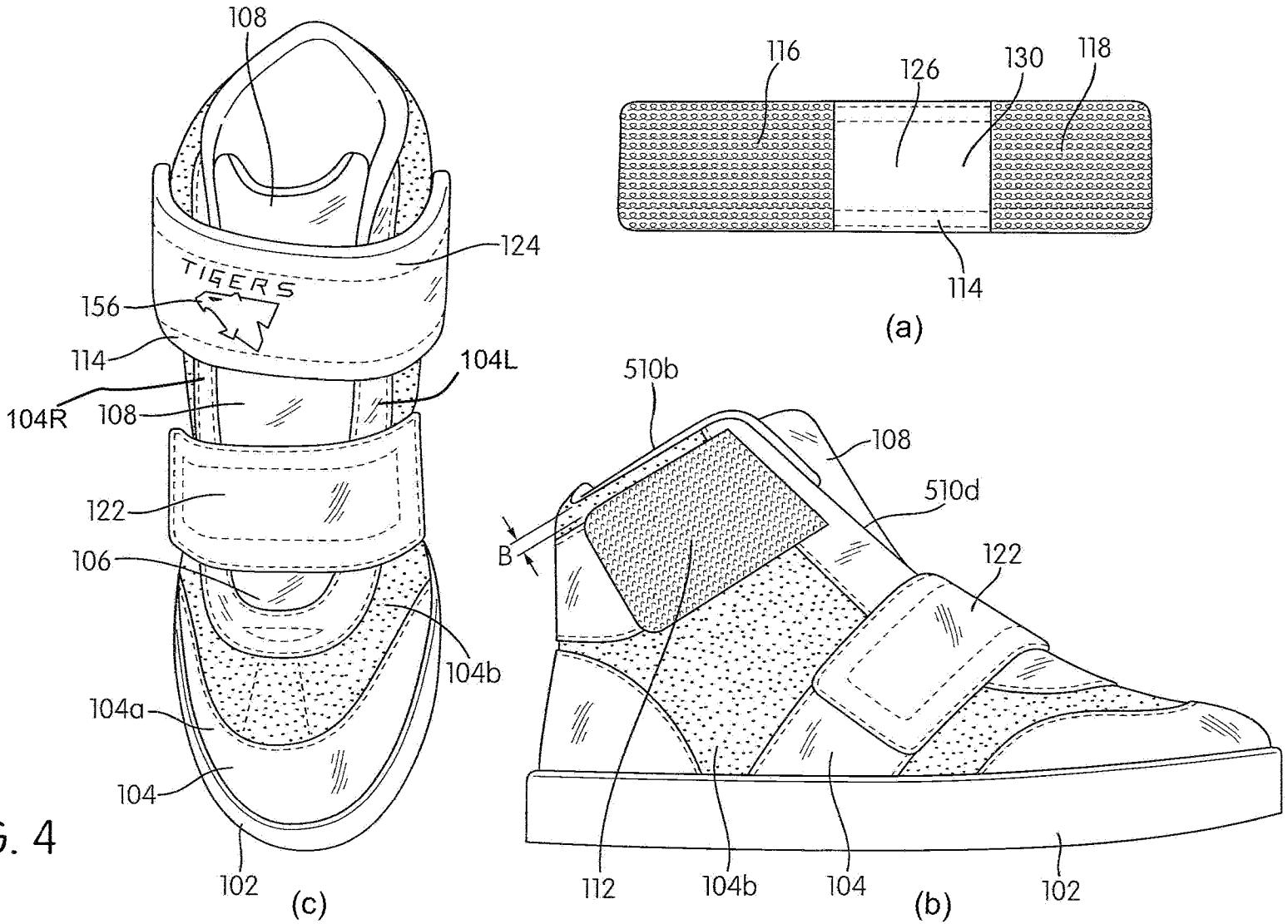
Figure 5:
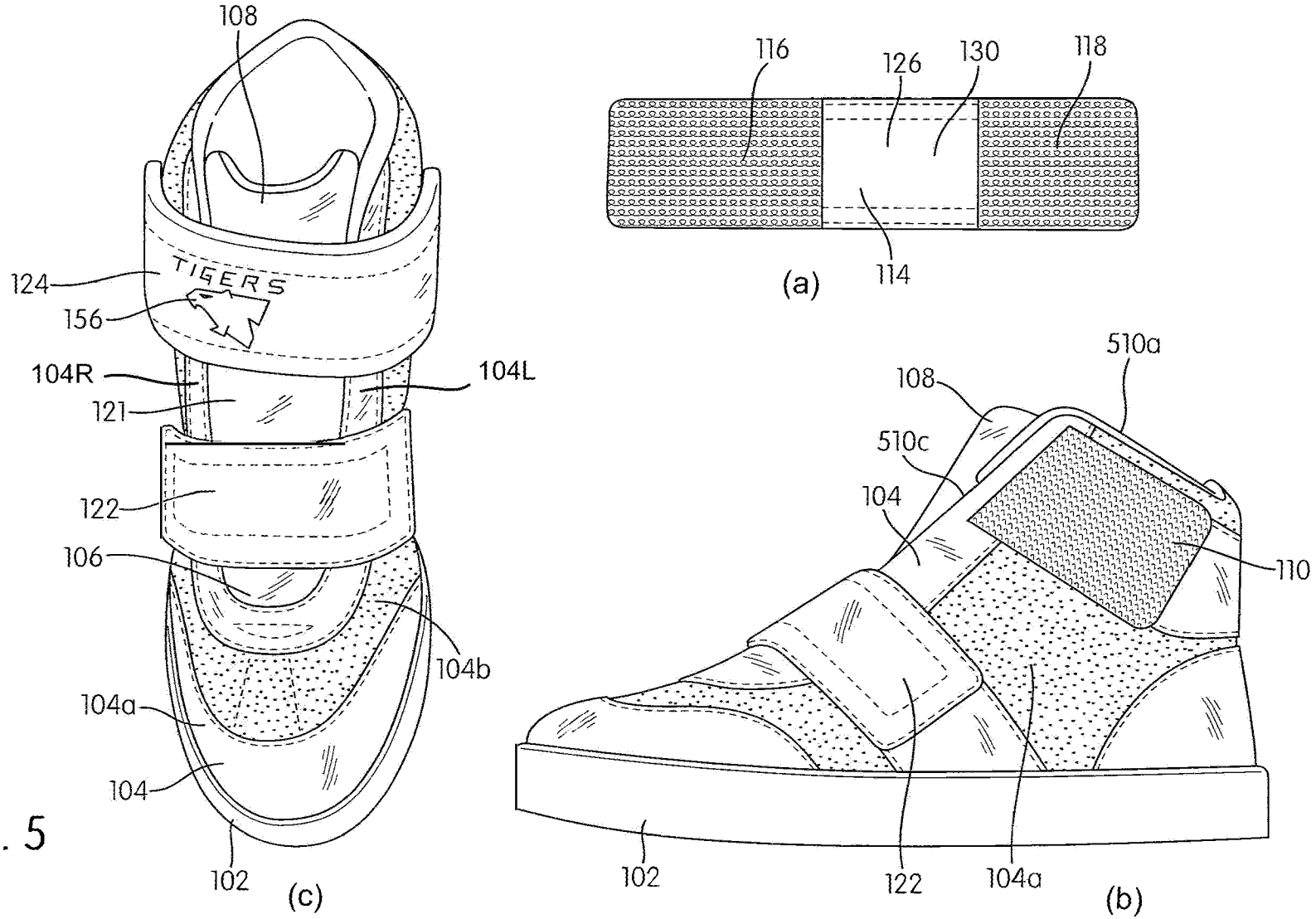

In one embodiment, as shown in FIGS. 4 and 5, the removable and printable connector strap 114 has the outwardly facing surface 124 and the inwardly facing surface 126. In one embodiment, the inwardly facing surface 126 faces the shoe upper 104 when the removable and printable connector strap 114 is releasably connected to the shoe upper 104. In other words, when the strap 114 is connected to the shoe upper 104 extending from the first side of the shoe upper to the second side of the shoe upper (as shown in FIGS. 4*c* and 5*c*), the outwardly facing surface 124 faces away from the shoe upper 104, and the inwardly facing surface 126 faces toward the shoe upper 104.

In one embodiment, the outwardly facing surface 124 of the removable and printable connector strap 114 has a width $W_p$ (as shown in FIGS. 2A-2C) in the leg to toe direction of at least ⅝ inch that is devoid of stitching. In one embodiment, the width $W_p$ is smaller than the width $W_s$. In one embodiment, the outwardly facing surface 124 of the removable and printable connector strap 114 has a width $W_p$ of at least 0.8 inch that is devoid of stitching. In one embodiment, the outwardly facing surface 124 of the removable and printable connector strap 114 has a width $W_p$ of at least 1 inch that is devoid of stitching. In one embodiment, the outwardly facing surface 124 of the removable and printable connector strap 114 has a width of at least 1.3 inches that is devoid of stitching.

In one embodiment, the removable and printable connector strap 114 may be formed of a single layer of material. In one embodiment, the single layer of material may include the outwardly facing surface 124. In one embodiment, the first releasable connector portion 116 and the second releasable connector portion 118 are attached to the inwardly facing surface of the single layer of material. In such an embodiment, the first releasable connector portion 116 and the second releasable connector portion 118 form the inwardly facing surface 126 of the removable and printable connector strap 114. In one embodiment, the single layer of material of the removable and printable connector strap 114 may be made of leather, polyester, canvas, patent leather, a synthetic material, such as vinyl, a synthetic fabric such as a woven or a non-woven nylon fabric, etc.

In one embodiment, stitches may be used to connect the single layer of material of the removable and printable connector strap 114 to the first releasable connector portion 116 and the second releasable connector portion 118. In one embodiment, a single peripheral or circumferential stitching may be used to connect the single layer of material, the first releasable connector portion 116 and the second releasable connector portion 118 together to form the removable and printable connector strap 114. In one embodiment, two peripheral or circumferential stitches may be used to connect the single layer of material, the first releasable connector portion 116 and the second releasable connector portion 118 together to form the removable and printable connector strap 114. In one embodiment, two peripheral or circumferential stitches may be disposed such that they are concentrically positioned to each other. In another embodiment, other connection or attachment mechanisms, such as, but not limited to adhesive, heat welding may be used to connect the single layer of material, the first releasable connector portion 116 and the second releasable connector portion 118 together to form the removable and printable connector strap 114. In such an embodiment, where the removable and printable connector strap 114 is devoid of stitching, the width $W_p$ is same as the width $W_s$.

In one embodiment, the removable and printable connector strap 114 may include a first layer and a second layer, each layer may be made of the same material or different materials. In one embodiment, the first layer may include the outwardly facing surface 124 and the second layer may include the inwardly facing surface 126.

In one embodiment, the first releasable connector portion 116 and the second releasable connector portion 118 are attached to the first layer. In one embodiment, the second layer may extend between the first releasable connector portion 116 and the second releasable connector portion 118. In one embodiment, the second layer may extend to at least partially overlap the first releasable connector portion 116 so as to enable at least a connection between the second layer and the first releasable connector portion 116. Similarly, the second layer may extend to at least partially overlap the second releasable connector portion 118 so as to enable at least a connection between the second layer and the second releasable connector portion 118.

In one embodiment, the second layer may extend along the entire length of the removable and printable connector strap 114. In one embodiment, the first releasable connector portion 116 and the second releasable connector portion 118 are attached to the second layer.

In one embodiment, the removable and printable connector strap 114 may be made of leather, canvas, a synthetic material, such as vinyl, a synthetic fabric such as a woven or a non-woven nylon fabric, etc. For example, in one embodiment, the first layer of the removable and printable connector strap 114 may be made of a synthetic fabric such as a woven or a non-woven nylon fabric. In another embodiment, the first layer of the removable and printable connector strap 114 may be made of a patent leather material. In yet another embodiment, the first layer of the removable and printable connector strap 114 may be made of a synthetic material, such as vinyl.

In one embodiment, a layer of padding or stuffing material is positioned between the first layer and the second layer of the removable and printable connector strap 114. For example, the padding or stuffing material may be made of polyester, fiber, foam, cotton, or other material. In one embodiment, the layer of padding or stuffing material is optional.

In one embodiment, a peripheral or circumferential stitch may be used to connect the first layer to the second layer of the removable and printable connector strap 114. In one embodiment, a single peripheral or circumferential stitching may be used to connect the first layer, the second layer, the first releasable connector portion 116 and the second releasable connector portion 118 together to form the removable and printable connector strap 114. In one embodiment, two peripheral or circumferential stitches may be used to connect the first layer, the second layer, the first releasable connector portion 116 and the second releasable connector portion 118 together to form the removable and printable connector strap 114. In one embodiment, two peripheral or circumferential stitches may be disposed such that they are concentrically positioned to each other.

In another embodiment, other connection or attachment mechanisms, such as, but not limited to adhesive, heat welding may be used to connect the first layer, the second layer, the first releasable connector portion 116 and the second releasable connector portion 118 together to form the removable and printable connector strap 114. In such an embodiment, where the removable and printable connector strap 114 is devoid of stitching, the width $W_p$ is same as the width $W_s$.

In one embodiment, the removable and printable connector strap 114 is devoid of openings or gaps therethrough. In one embodiment, the removable and printable connector strap 114 is devoid of any holes therethrough from a first side 128 (as shown in FIGS. 1A-3C) thereof to a second side 130 (as shown in FIGS. 4A-5C) thereof. In one embodiment, the first and second releasable connector portions 116 and 118 are disposed on the second side 130 of the removable and printable connector strap 114, while the indicia 156 are printed on the first side 128 of the removable and printable connector strap 114.

In one embodiment, the indicia 156 such as a sports team logo, a sports team mascots, a sports team name, a school or university indicia (letters or name), designs, a favorite character, symbols, monograms, insignia, affiliations, names, user created graphics, messages, images/pictures, or any combination thereof is placed on the outwardly facing surface 124 of the removable and printable connector strap 114 such that the indicia 156 is clearly visible to the wearer and passersby. In one embodiment, the indicia 156 are formed on the width $W_p$ of the outwardly facing surface 124 of the removable and printable connector strap 114.

In one embodiment, where the removable and printable connector strap 114 is devoid of stitching, the indicia 156 are formed on the width $W_s$ (that is same as the width $W_p$ in this embodiment) of the outwardly facing surface 124 of the removable and printable connector strap 114.

In one embodiment, the first releasable connector portion 116 is releasably connectable with the first permanent connector 110, and the second releasable connector portion 118 is releasably connectable with the second permanent connector 112.

In one embodiment, the first releasable connector portion 116 comprises a hook or loop material releasably connectable with the loop or hook material of the first permanent connector 112, and the second releasable connector portion 118 comprises a hook or loop material releasably connectable with the loop or hook material of the second permanent connector 114.

In one embodiment, the first and second releasable connector portions 116 and 118 both comprise hook materials that are releasably connectable with loop materials of the first and second permanent connectors 110 and 112. In another embodiment, the first and second releasable connector portions 116 and 118 both comprise loop materials that are releasably connectable with hook materials of the first and second permanent connectors 110 and 112. In yet another embodiment, the first releasable connector portion 116 comprises one of the hook and loop materials that is releasably connectable with other of the hook and loop materials of the first permanent connector 110, while the second releasable connector portion 118 comprises the other of the hook or loop materials that is releasably connectable with the corresponding hook and loop materials of the second permanent connector 112.

In one embodiment, the first releasable connector portion 116 and the second releasable connector portion 118 comprise spaced regions on a continuous hook or loop strip of material disposed on the removable and printable connector strap 114.

In one embodiment, the first releasable connector portion 116 and the second releasable connector portion 118 comprise first and second portions of hook or loop strip material disposed on the removable and printable connector strap 114. In one embodiment, the first releasable connector portion 116 and the second releasable connector portion 118 at least partially overlap each other so as to enable at least a connection therebetween. In one embodiment, the first releasable connector portion 116 and the second releasable connector portion 118 are positioned such that at least one width dimension or side of the first releasable connector portion 116 and the second releasable connector portion 118 are adjacent to each other so as to enable at least a connection therebetween.

In one embodiment, as shown in FIGS. 4A-5C, the first releasable connector portion 116 and the second releasable connector portion 118 comprise spaced, discrete first and second portions of hook or loop strip material disposed on the removable and printable connector strap 114.

In one embodiment, the first and second releasable connector portions 116 and 118 may be releasably connected with the first and second permanent connectors 116 and 118 using other removable/releasable attachment mechanisms, such as, snap fasteners, reusable adhesives, buttons and button holes, hook and eye closures, magnetic snap fasteners, etc. or any combination thereof.

Figure 10A:
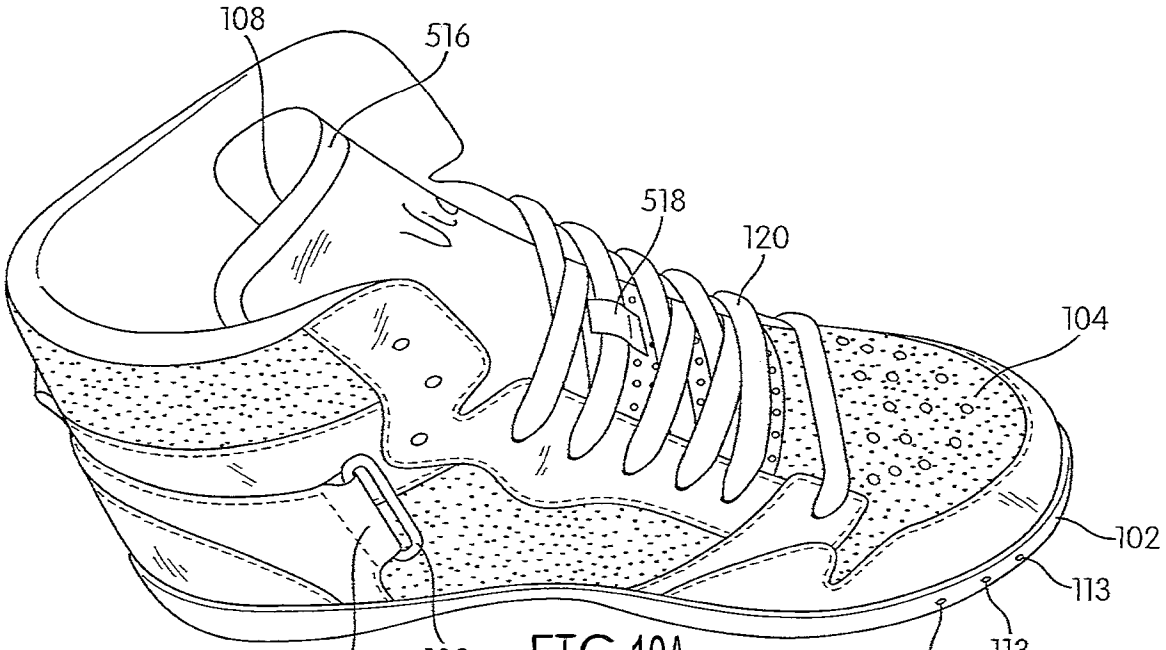
Figure 10B:
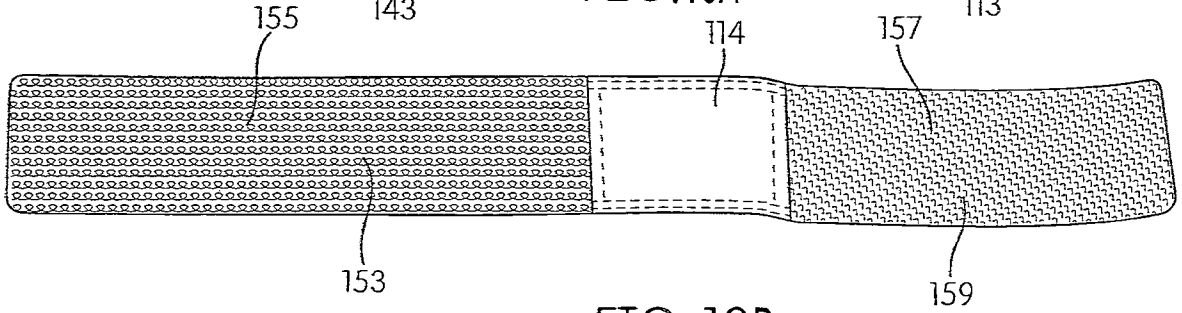
Figure 11:
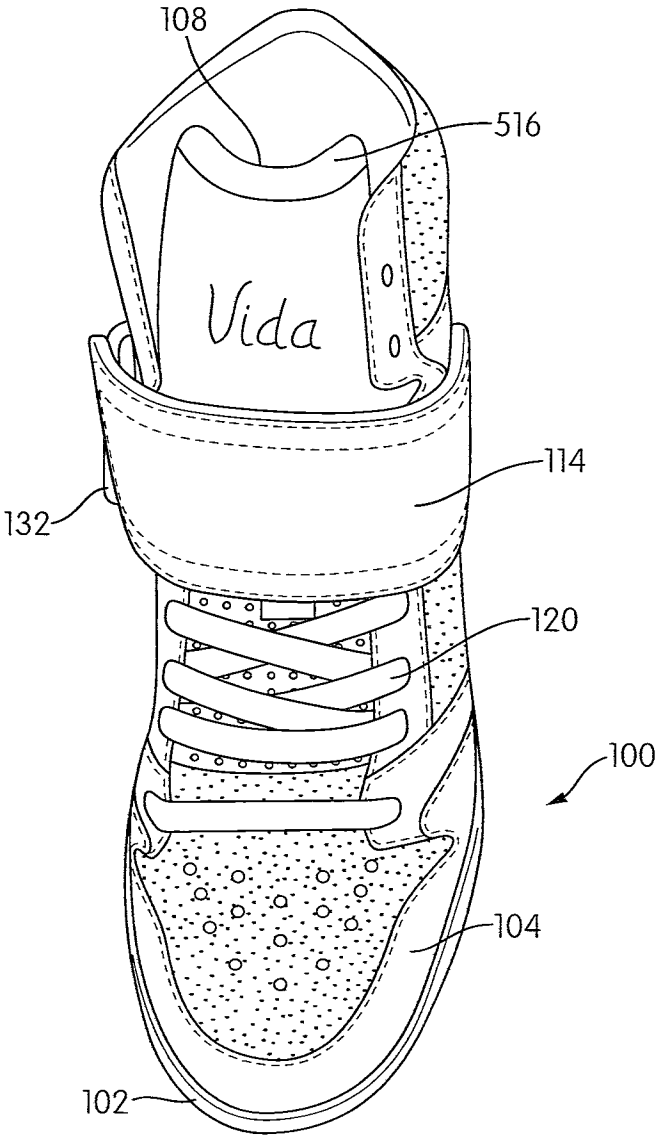
FIG. 11 shows another front perspective view of the left shoe system of FIG. 6.
Figures 12A, 12B:
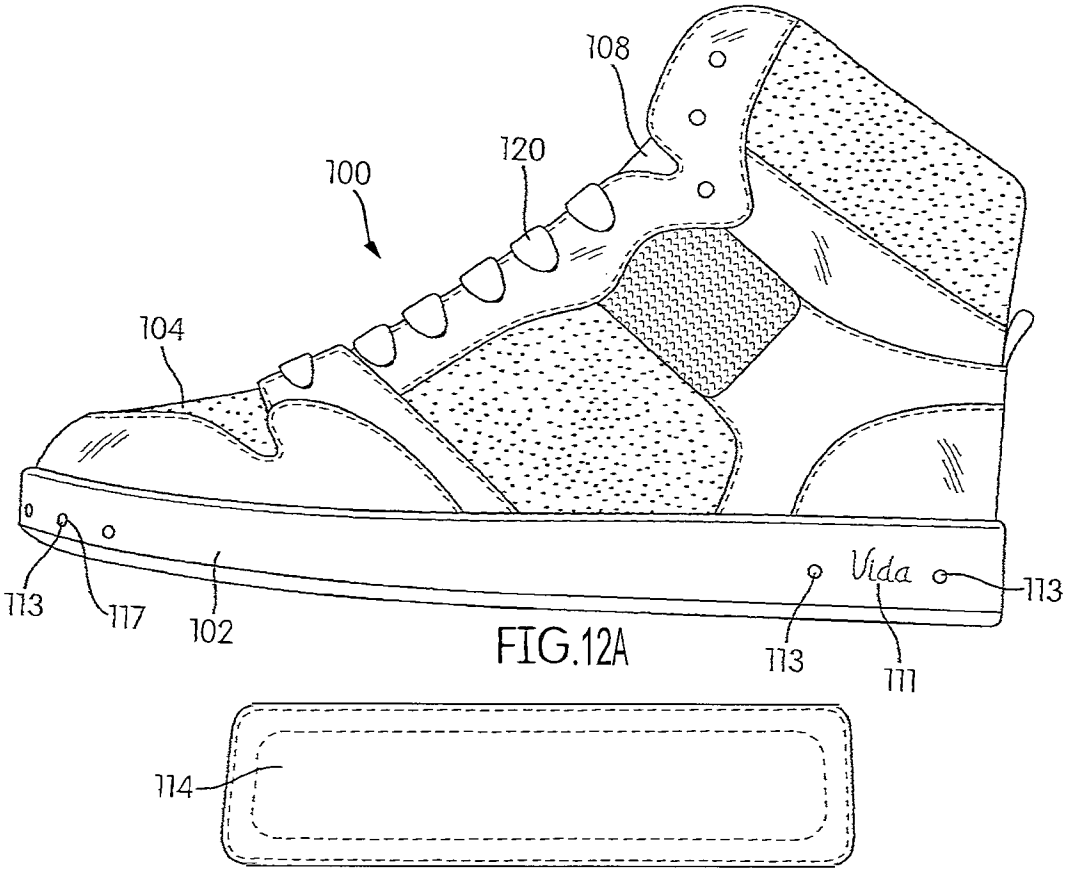
FIG. 12A shows a right side elevational view of the shoe system of FIG. 11, wherein removable and printable connector strap of the shoe system is removed from and positioned adjacent to the shoe system, and wherein a top plan view of the removable and printable connector strap is shown in FIG. 12B.
Figure 13A:
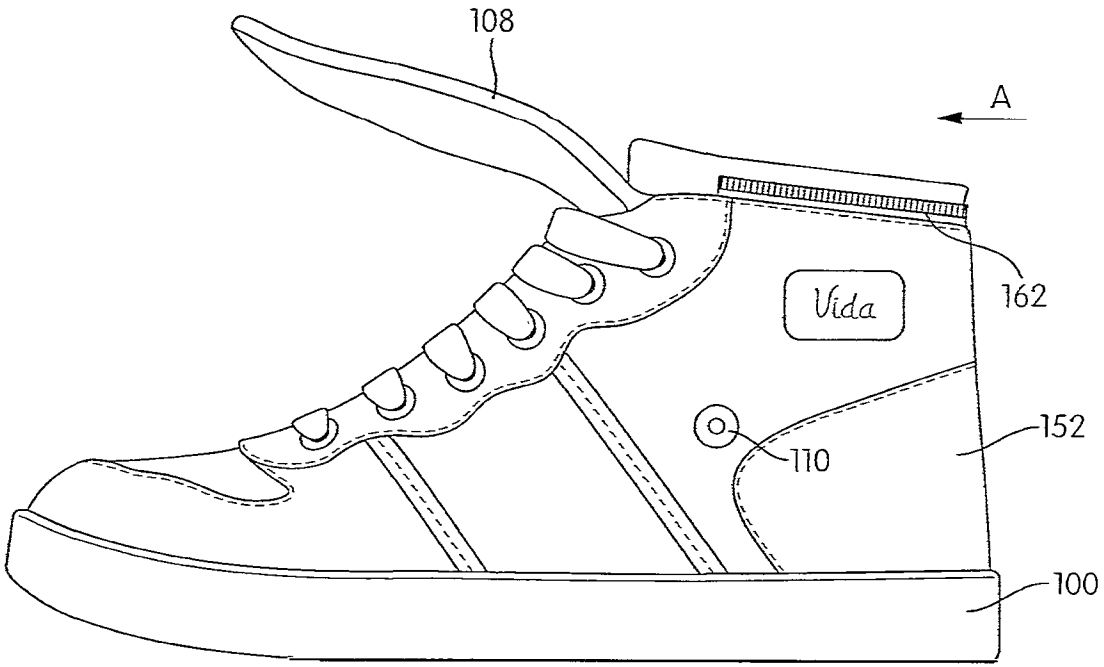
FIG. 13A shows a right side elevational view of a left shoe system in accordance with yet another embodiment of the present patent application, wherein removable and printable connector strap of the left shoe system is removed from and positioned adjacent to the shoe system, and wherein a top plan view of the removable and printable connector strap is shown in FIG. 13B.
Figure 13B:
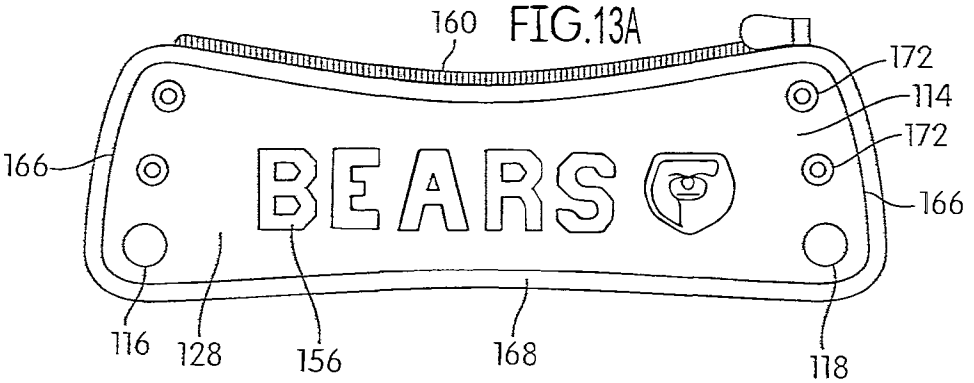

FIGS. 6-12B show the shoe system 100 in accordance with another embodiment of the present patent application. FIGS. 6 and 11 show the left shoe system 100 with the removable and printable connector strap 114 being releasably connected to its shoe upper 104. FIG. 11 shows the left shoe system 100 before the indicia 156 is printed on the removable and printable connector strap 114 and FIG. 6 shows the same left shoe system 100 after the indicia 156 is printed on the removable and printable connector strap 114. FIGS. 12A-B also show the removable and printable connector strap 114 before the indicia 156 is printed thereon. FIGS. 7-10B and 12A-B show the left shoe system 100 with the removable and printable connector strap 114 removed from and positioned adjacent to the shoe system 100. Top plan views of the removable and printable connector strap 114 are shown in FIGS. 7-9B and 12B and bottom plan view of the removable and printable connector strap 114 is shown in FIG. 10B.

In one embodiment, the structure and configuration of the shoe system 100 shown in FIGS. 6-12B are similar to the structure and configuration of the shoe system 100 as described in detail above with respect to FIGS. 1A-5C, and therefore, the structure and configuration of the shoe system 100 of FIGS. 6-12B will not be described in detail here, except for the differences noted below.

In one embodiment, the first permanent connector 110 comprises a portion of hook or loop material permanently connected to the first upper portion 104*a* and the second permanent connector 112 comprises the ring 132 (as shown in FIGS. 8-11) through which the removable and printable connector strap 114 passes.

In one embodiment, the ring 132 may be made of a plastic, a metal or any other hard material as would be appreciated by one skilled in the art. In one embodiment, the ring 132 may be permanently attached to the surface of the shoe upper 104. In one embodiment, a connector strap 143 (as shown in FIG. 8) may be used to attach the ring 132 to the surface of the shoe upper 104. For example, in one embodiment, one end of the connector strap 143 is passed through an opening in the ring 132 attached to the other end of the connector strap 143. In one embodiment, both the ends of the connector strap 143 are attached to each other, for example, using heat welding or adhesive. In one embodiment, both the attached ends of the connector strap 143 (with the ring 132 therebetween) are then permanently connected to the surface of the shoe upper 104 using stitches, heat welding, adhesive or any other attachment mechanisms as would be appreciated by one skilled in the art.

In one embodiment, the first releasable connector portion 116 and the second releasable connector portion 118 of the removable and printable connector strap 114 are positioned adjacent to each other. For example, in one embodiment, the first releasable connector portion 116 is disposed on at least half the length of the removable and printable connector strap 114, while the second releasable connector portion 118 is disposed on at least the other half length of the removable and printable connector strap 114. In one embodiment, the first releasable connector portion 116 includes one of the hook and loop material and the second releasable connector portion 118 includes the other of the hook and loop material.

In one embodiment, as shown in FIGS. 10A-B, a first portion 153 of the removable and printable connector strap 114 includes one of a hook and loop material 155 forming the first releasable connector portion 116, and wherein a second portion 157 of the removable and printable connector strap 114 includes the other of the hook and loop material 159 forming the second releasable connector portion 118.

In one embodiment, the second portion 157 is constructed and arranged to pass through the ring 132 and folded back over itself to capture the ring 132 therebetween such that the ring 132 (or the second permanent connector 112) is releasably connected to the second portion 157 (or the second releasable connector portion 118).

In one embodiment, the second portion 157 of the removable and printable connector strap 114 is constructed and arranged to pass through the ring 132 and folded back over itself such that at least a portion of the second portion 157 of the second releasable connector portion 118 is releasably connected to at least a portion of the first portion 153 of the first releasable connector portion 116 to secure the second portion 157 in its folded back configuration. For example, in one embodiment, at least a portion of a hook material 159 of the second releasable connector portion 118 is releasably connected to at least a portion of a loop material 155 of the first releasable connector portion 116 to secure the second portion 157 in its folded back configuration. In another embodiment, at least a portion of a loop material 159 of the second releasable connector portion 118 is releasably connected to at least a portion of a hook material 155 of the first releasable connector portion 116 to secure the second portion 157 in its folded back configuration.

In one embodiment, at least the other portion of the first releasable connector portion 116 is constructed and arranged to be connected to the first permanent connector portion 110 to releasably connect the removable and printable connector strap 114 to the shoe upper 104. For example, in one embodiment, at least the other portion of the hook material 155 of the first releasable connector portion 116 is constructed and arranged to be connected to a loop material of the first permanent connector portion 110 to releasably connect the removable and printable connector strap 114 to the shoe upper 104. In one embodiment, at least the other portion of the loop material 155 of the first releasable connector portion 116 is constructed and arranged to be connected to a hook material of the first permanent connector portion 110 to releasably connect the removable and printable connector strap 114 to the shoe upper 104.

In one embodiment, the structure and configuration of the shoe system 100 shown in FIGS. 13A-16 are similar to the structure and configuration of the shoe system 100 as described in detail above with respect to FIGS. 1A-5C, and therefore, the structure and configuration of the shoe system 100 of FIGS. 13A-16 will not be described in detail here, except for the differences noted below.

In one embodiment, as shown in FIGS. 13A-16, the removable and printable connector strap 114 is constructed and arranged to be connected to a portion 152 of the shoe system 100 that is disposed around the wearer's ankle when the shoe system 100 is worn by the wearer.

Figure 16:
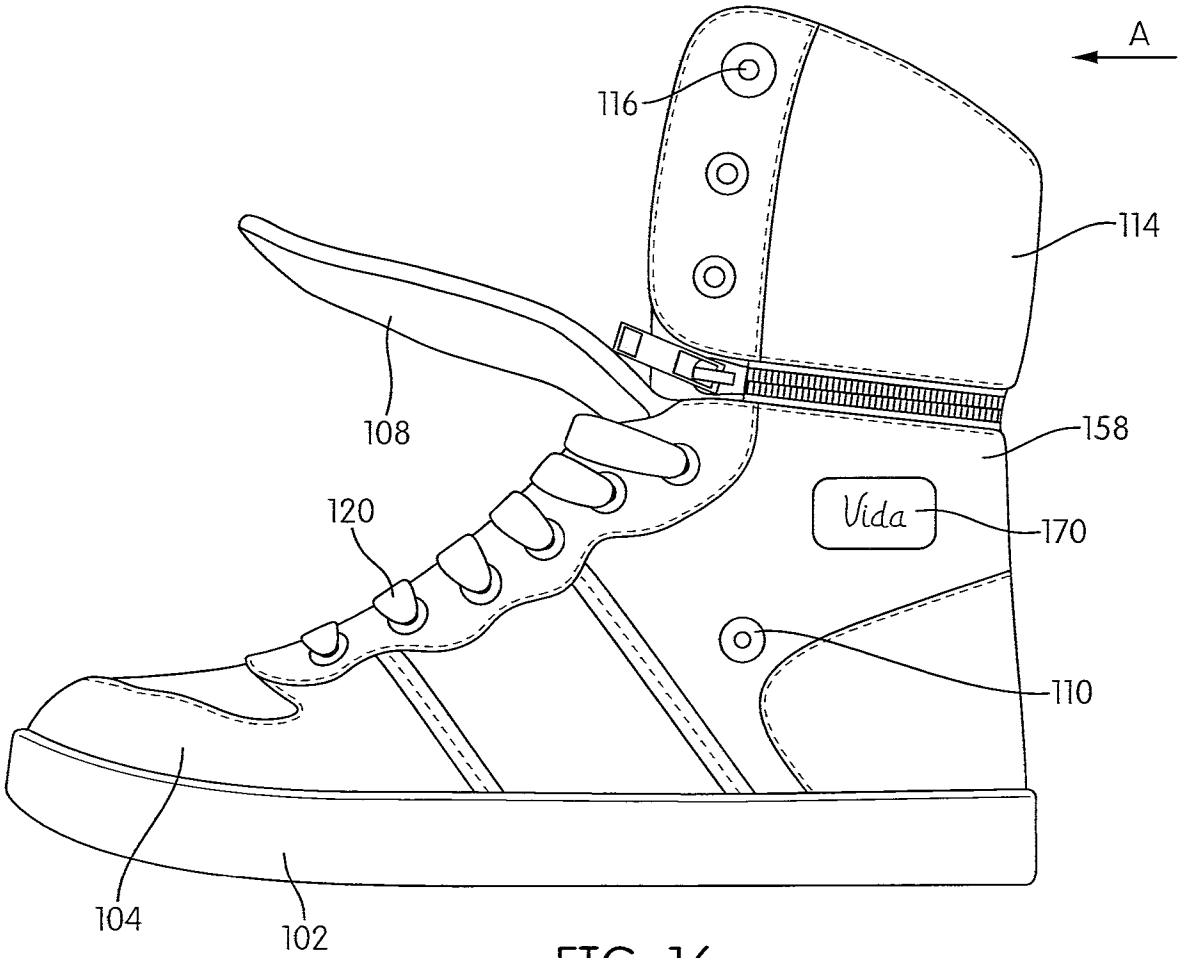
FIG. 16 shows a right side elevational view of the left shoe system of FIG. 13, wherein removable and printable connector strap of the shoe system is removed from the shoe system.

In one embodiment, the removable and printable connector strap 114 may include a stored configuration (as shown in FIG. 16) and a use configuration (as shown in FIGS. 14 and 15). In one embodiment, the wearer may be able to position the removable and printable connector strap 114 in either the stored configuration or the use configuration as desired.

For example, referring to FIG. 16, the removable and printable connector strap 114 is in its stored configuration in which the removable and printable connector strap 114 is removably attached to a portion 158 of the shoe system 100 such that the first side 128 (having indicia 156 thereon) is facing the wearer's ankle/leg. For example, when the removable and printable connector strap 114 is in its stored configuration, its first side 128 may be facing in the direction of an arrow A as shown in FIG. 16. That is, when the removable and printable connector strap 114 is in its stored configuration and the shoe system 100 is worn by the wearer, the indicia 156 formed on the removable and printable connector strap 114 are not visible to the wearer or a passerby.

Referring to FIGS. 14 and 15, the removable and printable connector strap 114 is positioned in its use configuration in which the removable and printable connector strap 114 is removably attached to the portion 152 of the shoe system 100 such that its first side 128 (having indicia 156 thereon) is facing outwardly, for example, in the direction of an arrow B. That is, when the removable and printable connector strap 114 is in its use configuration, the indicia 156 formed on the removable and printable connector strap 114 are clearly visible to the wearer or a passerby.

In one embodiment, the removable and printable connector strap 114 may include a third releasable connector portion 160 that is configured to be releasably connectable with a third permanent connector 162 so as to position the removable and printable connector strap 114 in its stored configuration. In one embodiment, as will be discussed below, the third releasable connector portion 160 and the third connector portion 162 may also be configured to position the removable and printable connector strap 114 in its use configuration. That is, in one embodiment, the third releasable connector portion 160 and the third connector portion 162 are configured to position the removable and printable connector strap 114 in either its stored configuration or its use configuration.

In one embodiment, the third permanent connector 162 is permanently connected to the shoe upper 104 using stitches, adhesives, heat welding or any other attachment mechanisms as would be appreciated by one skilled in the art. In one embodiment, the third permanent connector 162 is permanently connected to the portion 158 of the shoe upper 104 that is positioned around the wearer's ankle/leg when the shoe system 100 is worn by the wearer. In one embodiment, the third permanent connector 162 may include a zipper member. In another embodiment, the third permanent connector 162 may include a hook or loop material.

In one embodiment, the third releasable connector portion 160 may include a complementary zipper member that is configured to engage or connect with the zipper member of the third permanent connector 162 so as to position the removable and printable connector strap 114 in its stored configuration or its use configuration. In another embodiment, the third permanent connector 162 may include a complementary hook or loop material that is configured to engage or connect with a loop or hook material of the third permanent connector 162 so as to position the removable and printable connector strap 114 in its stored configuration or its use configuration.

In one embodiment, the third permanent connector 162 and third releasable connector portion 160 may include snap fasteners, buttons and button holes, hook and eye closures, magnetic snap fasteners, or any combination thereof.

In one embodiment, the wearer may release the connection between the third releasable connector portion 160 and the third permanent connector 162 to move the removable and printable connector strap 114 between its stored configuration and its use configuration. In one embodiment, the wearer may then turn the removable and printable connector strap 114 such its first side 128 (having indicia 156 thereon) is facing outwardly in the direction of the arrow B. In one embodiment, the wearer may then releasably connect the removable and printable connector strap 114 to the shoe upper 104 such that the indicia 156 formed on its first side 128 are clearly visible to the wearer or a passerby. In one embodiment, the removable and printable connector strap 114, in its use configuration, is releasably connected to the shoe upper 104 using the first and second releasable connector portions 116 and 118 and the first and second permanent connectors 110 and 112.

In one embodiment, the first and second releasable connector portions 116 and 118 and the first and second permanent connectors 110 and 112 may include buttons and button holes. In another embodiment, the first and second releasable connector portions 116 and 118 and the first and second permanent connectors 110 and 112 may include snap fasteners, hook and loop material, hook and eye closures, magnetic snap fasteners, or any combination thereof.

In one embodiment, when the removable and printable connector strap 114 is in its use configuration, in addition to the releasably connections between the first and second releasable connector portions 116 and 118 and the first and second permanent connectors 110 and 112, the removable and printable connector strap 114 may also be releasably connected to the shoe upper 104 using the third releasable connector portion 160 and the third permanent connector 162. In one embodiment, the releasable connection between the third releasable connector portion 160 and the third permanent connector 162, when the removable and printable connector strap 114 in its use configuration, is optional. In such an embodiment, the first and second releasable connector portions 116 and 118 may be positioned centrally along sides 166 of the removable and printable connector strap 114. In one embodiment, the first and second permanent connectors 110 and 112 may be positioned on portions of the shoe upper 104 such that they engage or connect with the centrally positioned the first and second releasable connector portions 116 and 118.

In one embodiment, the removable and printable connector strap 114 may include a decorative border 168 that is formed of a contrasting color (compared to the removable and printable connector strap 114). In one embodiment, the color of the decorative border may match the color of the indicia 156 formed on the removable and printable connector strap 114.

In one embodiment, the removable and printable connector strap 114 may include decorative elements or members 170. For example, the decorative elements or member 170 may be metal or plastic members having shoe system identification information printed thereon. For example, as shown in FIG. 16, such decorative members 170 may be disposed on a portion of the shoe system 100 that is positioned around the wearer's ankle.

In one embodiment, as shown in FIGS. 13A-16, the removable and printable connector strap 114 may include one or more decorative elements, such as grommets 172 positioned along its sides 166. In one embodiment, the removable and printable connector strap 114 may include one or more decorative elements, such as rhinestone embellishments. In one embodiment, the rhinestone embellishments may be attached to the removable and printable connector strap 114 using, for example, a (hat) glue gun. In one embodiment, the rhinestone embellishments may be attached to the removable and printable connector strap 114 using, for example, an embroidering procedure. In embodiment, the removable and printable connector strap 114 may include one or more decorative elements that are formed on the removable and printable connector strap 114, for example, using an embroidering procedure. In another embodiment, these decorative elements are optional.

Figure 17:
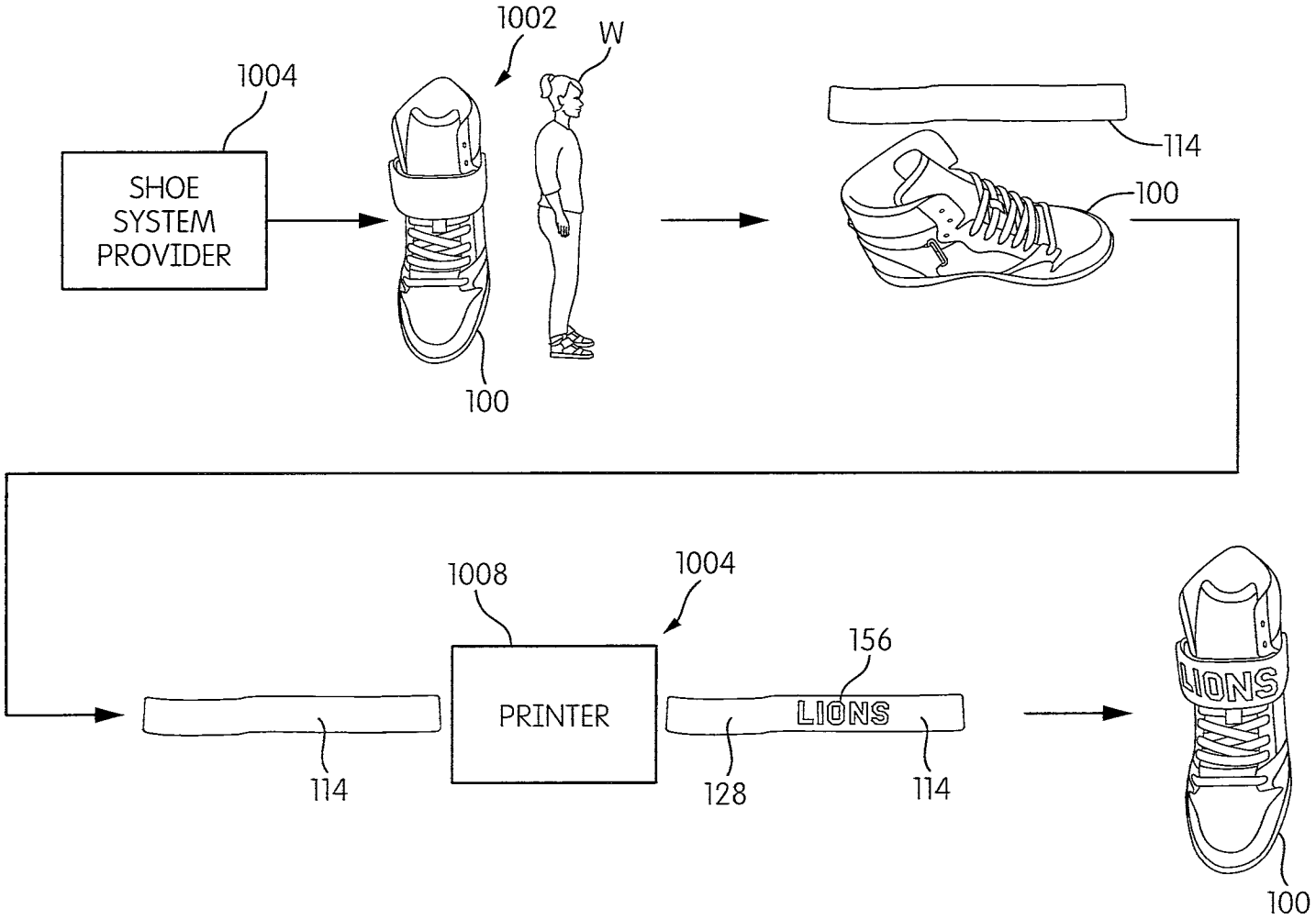
FIG. 17 shows a method of assembling the shoe system in accordance with an embodiment of the present patent application.

In one embodiment, referring to FIG. 17, a method 1000 of assembling the shoe system 100 is provided. The method 1000 includes procedure 1002 of receiving the shoe system 100 that has been shipped. In one embodiment, the shoe system 100 may be shipped by a shoe system provider 1004. In one embodiment, the shoe system 100 of the present patent application is configured to provide the wearer the ability to customize the shoe system 100 as desired after the assembly/manufacture of the shoe system 100 by the shoe system provider 1004.

The method also includes procedure 1006 of positioning the removable and printable connector strap 114 in a printer 1008, while the removable and printable connector strap 114 is entirely removed and separated from the shoe upper 104. In one embodiment, the removable and printable connector strap 114 is positioned in a flat configuration when the indicia 156 are printed on the first side 128 of the removable and printable connector strap 114.

In one embodiment, the indicia 156 may be printed directly onto the removable and printable connector strap 114 using a screen printing procedure. For example, a printing mesh may be used to transfer ink or other printing agent(s) onto the removable and printable connector strap 114 so as to print the desired indicia 156 thereon. In one embodiment, the indicia 156 may be printed directly onto the removable and printable connector strap 114 using a dye sublimation (e.g., transfer or direct) printing procedure. In one embodiment, the indicia 156 may be printed directly onto the removable and printable connector strap 114 using a heat or thermal transfer printing procedure. For example, in one embodiment, the desired indicia 156 may be ironed on to the removable and printable connector strap 114 using the thermal transfer printing procedure. In one embodiment, the indicia 156 may be printed directly onto the removable and printable connector strap 114 using an ink jet printing procedure. In one embodiment, an individual user may, thus, design and customize their shoe system 100 by printing the desired indicia 156 on the removable and printable connector strap 114 using one of the printing procedures discussed above.

In one embodiment, the shoe system 100 of the present patent application may be easily customizable for a variety of new wearers. For example, in one embodiment, an individual new wearer NW may receive the shoe system 100 from the shoe system provider 1004. After receiving the shoe system 100 that has been shipped by the shoe system provider 1004, the new wearer NW detaches (entirely removes and separates) the removable and printable connector strap 114 from the shoe upper 104. The new wearer NW then positions the removable and printable connector strap 114 in the printer 1008 to print their desired indicia 156 thereon. The new wearer NW then releasably connects the removable and printable connector strap 114 (with the desired indicia 156 printed thereon) to the shoe upper 104. Thus, each individual new wearer NW may be able customize the shoe system 100 as desired.

In one embodiment, an individual wearer may buy one pair of shoe systems that may include multiple removable and printable connector straps 114. Each of the removable and printable connector straps 114 may be used for creating different looks on the same shoe/shoe system. That is, in one embodiment, the shoe system provider 1004 may sell a shoe system kit that includes one pair of shoe systems and multiple removable and printable connector straps 114.

In one embodiment, the shoe system 100 may include two or more removable and printable connector straps 114, each with a different color or indicia. For example, in one embodiment, each of the two or more removable and printable connector straps 114 may be of the same color (e.g., may generally be of a contrasting color (compared to the shoe upper 104) to provide a desired decorative/aesthetic effect and/or visual interest to the shoe system 100). In one embodiment, the wearer may print same or different indicia on each of the two or more same colored, removable and printable connector straps 114. In one embodiment, each of the two or more removable and printable connector straps 114 may be of different colors (e.g., may generally be of different contrasting colors (compared to the shoe upper 104) to provide a desired decorative/aesthetic effect and/or visual interest to the shoe system 100). In one embodiment, the wearer may print same or different indicia on each of the two or more different colored, removable and printable connector straps 114. Thus, the shoe system 100 of the present patent application can be used to adapt it's appearance to conform readily to different uniforms or other clothing.

In one embodiment, the shoe system provider 1004 may also sell multiple removable and printable connector straps 114 (e.g., without the shoe system 100 itself) that an existing wearer EW can buy to update his existing shoe system 100. In one embodiment, the shoe system 100 is also configured to provide the ability to continuously customize to an existing wearer EW when the existing wearer EW would like to change/update their style/look or change their team/affiliation. For example, in one embodiment, the present patent application provides the existing wearer EW with a number of possibilities to use the same shoe system 100 while simply changing the existing removable and printable connector strap 114 with a new removable and printable connector strap to have different look/style and/or to be of a different team/affiliation. For example, an individual existing wearer EW may request and receive additional removable and printable connector strap(s) 114 (e.g., from the shoe system provider 1004) for their existing shoe system 100. In one embodiment, the individual existing wearer EW may then design and customize each of these additional removable and printable connector straps 114 with different design/indicia 156 (e.g., in the same way as described above). In one embodiment, the existing wearer EW may, thus, simply change the existing removable and printable connector strap 114 with the new/additional removable and printable connector strap 114 to match their new look/style/team/affiliation as and when desired.

In one embodiment, the shoe system of the present patent application is thus constructed and arranged to enable the wearer to mix and match their removable and printable connector strap(s) 114. For example, when a cheer team member wears these shoe systems, he/she can use the same shoe systems and retrofit the same shoe systems with different color or different printed removable and printable connector strap(s) for home and away games. That is, he/she can use the same shoe systems and simply retrofit the same shoe systems for different outfits/costumes/uniforms that he/she could be wearing during a performance, a game, and other events or for work.

In one embodiment, the shoe system of the present patent application may also be used by businesses, companies or corporations to print the name, motto or logo of their companies/corporations/businesses on the removable and printable connector strap(s). That is, in one embodiment, the shoe system of the present patent application may be used as part of the companies/corporations/businesses' employees' work uniform. In one embodiment, such businesses, companies or corporations may include, but not limited to, restaurant chain companies/corporations/businesses, hotel chain companies/corporations/businesses, package/mail/courier delivery companies/corporations/businesses, etc. In one embodiment, the shoe system of the present patent application may also be implemented by work uniform suppliers.

The portions and dimensions of various parts of the exemplary shoe system as shown and described here are intended to be merely exemplary and not limiting in any way. The various parts of the exemplary shoe system are drawn to scale in accordance with one embodiment, although other scales and shapes may be used in other embodiments. The dimensions of various parts of the exemplary shoe system are measured in millimeters, centimeters, or inches unless indicated otherwise. In one embodiment, the dimensions of various parts of the exemplary shoe system, as shown and described here, are up to 5 percent greater than or up to 5 percent less than those illustrated and described. In another embodiment, the dimensions of various parts of the exemplary shoe system, as shown and described here, are up to 10 percent greater than or up to 10 percent less than those illustrated and described. In yet another embodiment, the dimensions of various parts of the exemplary shoe system, as shown and described here, are up to 20 percent greater than or up to 20 percent less than those illustrated and described.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed above could be termed a second element, component, region, layer or section without departing from the teachings of the exemplary embodiments.

Although the present patent application has been described in detail for the purpose of illustration, it is to be understood that such detail is solely for that purpose and that the present patent application is not limited to the disclosed embodiments, but, on the contrary, is intended to cover modifications and equivalent arrangements that are within the spirit and scope of the appended claims. In addition, it is to be understood that the present patent application contemplates that, to the extent possible, one or more features of any embodiment can be combined with one or more features of any other embodiment.

What is claimed is:

1. A method of assembling a shoe system, comprising:

receiving a shoe system comprising:

a sole;

a shoe upper connected with the sole, the shoe upper including a first upper portion and a second upper portion;

a first permanent connector positioned on the first upper portion and located at a first side of the shoe upper, the first permanent connector being permanently connected to the first upper portion;

a second permanent connector positioned on the second upper portion and located at a second side of the shoe upper opposite to the first side of the shoe upper, the second permanent connector being permanently connected to the second upper portion; and a removable and printable connector strap connectable across the shoe upper between the first permanent connector and the second permanent connector on the shoe upper, the removable and printable connector strap comprising a first releasable connector portion and a second releasable connector portion, the first releasable connector portion being releasably connectable with the first permanent connector at the first side of the shoe upper, and the second releasable connector portion being releasably connectable with the second permanent connector at the second side of the shoe upper, the connector strap comprising an outwardly facing surface configured to face away from the shoe upper and an inwardly facing surface configured to face toward the shoe upper, the connector strap comprising stitching;

positioning the received removable and printable connector strap, including the first releasable connector portion, the second connector portion, and the stitching thereof, in a printer, while the received removable and printable connector strap is entirely separated from the shoe upper, and printing indicia onto the outwardly facing surface of the received removable and printable connector strap with the printer to customize the received shoe system as desired, wherein there is no pre-existing printing on the outwardly facing surface of the received removable and printable connector strap prior to the indicia being printed on the outwardly facing surface, and wherein the first releasable connector portion of the removable and printable connector strap is configured to adjustably connect to the first permanent connector of the shoe upper for tightness adjustment of the shoe upper around a foot of a wearer.

2. The method of claim 1, wherein a gap is disposed between the first upper portion and the second upper portion; and further comprising a tongue below the shoe upper and at least partially spanning the gap between the first upper portion and the second upper portion, and wherein the removable and printable connector strap is configured to allow for tightness adjustment of the shoe upper and the tongue around the wearer's foot.

3. The method of claim 2, wherein at least one of the first releasable connector portion and the second releasable connector portion of the removable and printable connector strap is configured to be selectively adjustably connectable with the corresponding first permanent connector or second permanent connector of the shoe upper so as to span the gap between the first upper portion and the second upper portion, wherein the removable and printable connector strap is configured to serve as a shoe fastening/closure strap to either loosen or tighten the shoe system on the wearer's foot.

4. The method of claim 1, wherein the printer includes a heat or thermal transfer printer and wherein the indicia are printed onto the shipped and received removable and printable blank connector strap with the heat or thermal transfer printer using a heat or thermal transfer printing procedure.

5. The method of claim 4, where the indicia are ironed onto the received removable and printable connector strap using the thermal transfer printing procedure.

6. The method of claim 1, wherein the removable and printable connector strap has a width in the leg to toe direction of at least ⅞ inch.

7. The method of claim 6, wherein the removable and printable connector strap has a width in the leg to toe direction of at least 1⅛ inches.

8. The method of claim 1, wherein the removable and printable connector strap has a width in the leg to toe direction between ⅞ inch and 2½ inches.

9. The method of claim 1, wherein the removable and printable connector strap is devoid of any holes therethrough from a first side thereof to a second side thereof of the connector strap.

10. The method of claim 9, wherein the removable and printable connector strap includes padding material positioned between the first and second sides of the removable and printable connector strap.

11. The method of claim 1, wherein the first permanent connector and the second permanent connector are stitched, adhesively bonded, or welded to the shoe upper.

12. The method of claim 11, wherein the first releasable connector portion comprise hook or loop material releasably connectable with corresponding loop or hook material of the first permanent connector.

13. The method of claim 12, wherein the second releasable connector portion comprise hook or loop material releasably connectable with corresponding loop or hook material of the second permanent connector.

14. The method of claim 1, wherein the first releasable connector and the second releasable connector are stitched on the inwardly facing surface of the connector strap.

15. The method of claim 1, wherein the connector strap comprises a first layer stitched to a second layer, and a padding layer disposed between the first layer and the second layer that are stitched together.

16. The method of claim 1, wherein the received connector strap is separated from the shoe upper when received.

17. The method of claim 16, wherein the received strap is connected to the shoe upper for the first time only after printing the indicia on the outwardly facing surface of the received strap.

18. A method of assembling a shoe system, comprising:

receiving a shoe system comprising:

a sole;

a shoe upper connected with the sole, the shoe upper including a first upper portion and a second upper portion;

a first permanent connector positioned on the first upper portion and located at a first side of the shoe upper, the first permanent connector being permanently connected to the first upper portion;

a second permanent connector positioned on the second upper portion and located at a second side of the shoe upper opposite to the first side of the shoe upper, the second permanent connector being permanently connected to the second upper portion; and a removable and printable connector strap connectable across the shoe upper between the first permanent connector and the second permanent connector on the shoe upper, the removable and printable connector strap comprising a first releasable connector portion and a second releasable connector portion, the first releasable connector portion being releasably connectable with the first permanent connector at the first side of the shoe upper, and the second releasable connector portion being releasably connectable with the second permanent connector at the second side of the shoe upper, the connector strap comprising an outwardly facing surface configured to face away from the shoe upper and an inwardly facing surface configured to face toward the shoe upper, the connector strap comprising stitching;

positioning the received removable and printable connector strap, including the first releasable connector portion, the second connector portion, and the stitching thereof, in a printer, while the received removable and printable connector strap is entirely separated from the shoe upper, and printing indicia onto the outwardly facing surface of the received removable and printable connector strap with the printer to customize the received shoe system as desired, wherein the received strap is connected to the shoe upper for the first time after printing the indicia on the outwardly facing surface of the received strap, and wherein the first releasable connector portion of the removable and printable connector strap is configured to adjustably connect to the first permanent connector of the shoe upper for tightness adjustment of the shoe upper around a foot of a wearer.

* * * * *